US007769574B2

(12) United States Patent
Kelson et al.

(10) Patent No.: US 7,769,574 B2
(45) Date of Patent: Aug. 3, 2010

(54) BESSEL ANALYTIC ELEMENT SYSTEM AND METHOD FOR COLLECTOR WELL PLACEMENT

(75) Inventors: Victor A Kelson, Bloomington, IN (US); Mark Bakker, Athens, GA (US); John F Wittman, Bloomington, IN (US)

(73) Assignee: Wittman Hydro Planning

( * ) Notice: Subject to any disclaimer, the term of this patent is extended or adjusted under 35 U.S.C. 154(b) by 961 days.

(21) Appl. No.: 11/045,759

(22) Filed: Jan. 28, 2005

(65) Prior Publication Data

US 2005/0171750 A1 Aug. 4, 2005

Related U.S. Application Data

(60) Provisional application No. 60/540,728, filed on Jan. 30, 2004.

(51) Int. Cl.
*G06F 17/10* (2006.01)
*G06G 7/48* (2006.01)

(52) U.S. Cl. ..... 703/10; 703/2

(58) Field of Classification Search ..... 703/2, 703/10

See application file for complete search history.

(56) References Cited

U.S. PATENT DOCUMENTS 5,813,798 A 9/1998 Whiffen
6,151,566 A 11/2000 Whiffen
6,227,045 B1 5/2001 Morse et al.

OTHER PUBLICATIONS

Bakker et al.; Analytic elements for multiaquifer flow; Journal of Hydrology 271 (2003) 119-129; publically available Dec. 2002.*
Penmatcha et al.; A Comprehensive Reservoir/Wellbore Model for Horizontal Wells; SPE 39521; 1998; pp. 1-15.*
Philip Nienhuis, MLPU Users Manual, Version 3.20, Mar. 15, 2001.
Stewart, David R, "Three-dimensional analysis of the capture of contaminated leachate by fully penetrating, partially penetrating, and horizontal wells," *Water Resources Research*, vol. 35, No. 2, pp. 461-468 (Feb. 1999).

(Continued)

*Primary Examiner*—Hugh Jones
(74) *Attorney, Agent, or Firm*—Baker & Daniels LLP

(57) ABSTRACT

The present invention involves a method of developing a model of groundwater flow with a well configuration. First, a geographic area is specified with one or more related wells. A mathematical model is created of the groundwater flow in relation to the wells with a plurality of layers, each layer having a local flow component and a leakage component. The plurality of layers is modified based on the leakage component of adjacent layers. The simulation of groundwater flow to a collector well, horizontal well, or gallery may thus be accomplished by specifying an array of line-sink elements that represent the lateral arms of the collector well, horizontal well, or gallery. Boundary conditions for groundwater flow to the lateral arms may then be specified. Groundwater flows are then calculated based on the array and boundary conditions, with updating of the boundary conditions during the calculation. Each of the layers may include a component related to frictional head loss. The head losses due to flow into and within the lateral arms may be used to update the layers. Modifications of the models may involve calculating discharge potentials or a head specified condition.

22 Claims, 23 Drawing Sheets

Layout of line-sink elements in a collector well

OTHER PUBLICATIONS

Stewart, David R et al., "Gaining and losing sections of horizontal wells," *Water Resources Research*, vol. 37, No. 11, pp. 2677-2685 (Nov. 2001).
Stewart, David R, "Deformation of stream surfaces in steady axisymmetric flow," *Water Resources Research*, vol. 37, No. 2, pp. 307-315 (Feb. 2001).
Strack, O.D.L. et al., "A multi-quadric area-sink for analytic element modeling of groundwater flow," *Journal of Hydrology*, 226, pp. 188-196. (Feb. 2000) (Abstract only).
GFLOW 2000: an analytical element ground water flow modeling system. (Software Spotlight), *Ground Water* (Nov. 2002) (partial article).
Steward, David Ray, *Vector Potential Functions and Stream Surfaces in Three Dimensional Groundwater Flow*, Thesis, Nov. 1996, University of Minnesota, Minneapolis, MN, 136 p.
Strack, Otto D.L., *Groundwater Mechanics*,1999, Strack Consulting, Inc., North Oaks, MN, 732 p., (see pp. 396-401 for discussion of collector wells), pp. 396-401 considered.
Bakker, Mark and Otto D.L. Strack, *Analytic elements for multiaquifer flow*, Journal of Hydrology 271 (2003) 119-129, www.elsevier.com/locate/jhydrol, New York, NY.
Haitjema, H. M. *Analytic Element Modeling of Groundwater Flow*, 1995, Academic Press, Inc.; San Diego, CA, 207 p.
USGS Ground-Water Software, MODFLOW-2000 Version 1.18.00, *Summary of MODFLOW-2000*, 12 p., http://water.usgs.gov/nrp/gwsoftware/modflow2000/Mf2k.txt.
Winston, Richard B., Compilation for *Online Guide to MODFLOW* with Index and related files, 57 p., http://water.usgs.gov/nrp/gwsoftware/modflow2000/MFDOC/modflowguide__content__dyn.html May 27, 2008.
Harbaugh, A.W., Banta, E.R., Hill, M.C., and McDonald, M.G., 2000, MODFLOW-2000, the U.S. Geological Survey modular ground-water model—User guide to modularization concepts and the Ground-Water Flow Process: U.S. Geological Survey Open-File Report 00-92, 130 p.
Hill, M.C., Banta, E.R., Harbaugh, A.W., and Anderman, E.R., 2000, MODFLOW-2000, the U.S. Geological Survey modular ground-water model—User guide to the Observation, Sensitivity, and Parameter-Estimation Processes and three post-processing programs: U.S. Geological Survey Open-File Report 00-184, 219 p.
Hill, M.C., 1998, Methods and guidelines for effective model calibration: U.S. Geological Survey Water-Resources Investigations Report 98-4005, 98 p. [with application to UCODE, a computer code for universal inverse modeling, and MODFLOWP, a computer code for inverse modeling with MODFLOW]. (MODFLOW-2000 replaces MODFLOWP.).
Höffmann, J., Leake, S.A., Galloway, D.L., and Wilson, A.M., 2003, MODFLOW-2000 Ground-Water Model—User Guide to the Subsidence and Aquifer-System Compaction (SUB) Package: U.S. Geological Survey Open-File Report 03-233, 54 p.
Halford, K.J. and Hanson, R.T., 2002, User guide for the drawdown-limited, multi-node well (MNW) package for the U.S. Geological Survey's modular three-dimensional finite-difference ground-water flow model, versions MODFLOW-96 and MODFLOW-2000: U.S. Geological Survey Open-File Report 02-293, 39 p.
Zheng, Chunmiao, Hill, M.C., and Hsieh, P.A., 2001, MODFLOW-2000, the U.S. Geological Survey modular ground-water model—User guide to the LMT6 package, the linkage with MT3DMS for multi- species mass transport modeling: U.S. Geological Survey Open-File Report 01-82, 51 p.
Mehl, S.E. and Hill, M.C., MODFLOW-2000, the U.S. Geological Survey modular ground-water model—User guide to the LINK-AMG (LMG) Package for solving matrix equations using an algebraic multigrid solver: U.S. Geological Survey Open-File Report 01-177, 40 p.
Anderman, E.R. and Hill, M.C., 2001, MODFLOW-2000, the U.S. Geological Survey modular ground-water model—Documentation of the Advective-Transport Observation (ADV2) Package, version 2: U.S. Geological Survey Open-File Report 01-54, 79 p.
Program modification of the ADV2 package MODFLOW-2000, the U.S. Geological Survey modular ground-water model—Documentation of effective-porosity parameters in the Advective-Transport Observation (ADV2) Package, 12 p.
A short description of the ADV2 package that is documented in Open-File Report 01-54: Anderman, E.R. and Hill, M.C., 2001, Improving ground-water flow model calibration with the advective-transport observation (ADV2) package to MODFLOW-2000: U.S. Geological Survey Fact Sheet FS-059-98, 2 p.
Anderman, E.R., and Hill, M.C., 2000, MODFLOW-2000, the U.S. Geological Survey modular ground-water model—Documentation of the Hydrogeologic-Unit Flow (HUF) Package: U.S. Geological Survey Open-File Report 00-342, 96 p.
Anderman, E.R., Kipp, K.L., Hill, M.C., Valstar, Johan, and Neupauer, R.M., 2002, MODFLOW-2000, the U.S. Geological Survey modular ground-water model—Documentation of the Model-Layer Variable-Direction Horizontal Anisotropy (LVDA) capability of the Hydrogeologic-Unit Flow (HUF) Package: U.S. Geological Survey Open-File Report 02-409, 70 p.
Anderman, E.R., and Hill, M.C., 2003, MODFLOW-2000, the U.S. Geological Survey modular ground-water model—Three additions to the Hydrogeologic-Unit Flow (HUF) Package: Alternative storage for the uppermost active cells, Flows in hydrogeologic units, and the Hydraulic-coductivity depth-dependence (KDEP) capability: U.S. Geological Survey Open-File Report 03-347, 43 p.
Banta, E.R., 2000, MODFLOW-2000, the U.S. Geological Survey modular ground-water model—Documentation of packages for simulating evapotranspiration with a segmented function (ETS1) and drains with return flow (DRT1): U.S. Geological Survey Open-File Report 00-466, 131 p.
Merritt, L.M. and Konikow, L.F., 2000, Documentation of a computer program to simulate lake-aquifer interaction using the MODFLOW ground-water flow model and the MOC3D solute-transport model: U.S. Geological Survey Water-Resources Investigations Report 00-4167, 153 p.
Hanson, R.T. and Leake, S.A., 1999, Documentation of HYDMOD, a program for extracting and processing time-series data from the U.S. Geological Survey's modular three-dimensional finite-difference ground-water flow model: U.S. Geological Survey Open-File Report 98-564 57 p.
Jobson, H.E. and Harbaugh, A.W., 1999, Modifications to the diffusion analogy surface-water flow model (DAFLOW) for coupling to the modular finite-difference ground-water flow model (MODFLOW): U.S. Geological Survey Open-File Report 99-217, 115 p.
Harbaugh, A.W., and McDonald, M.G., 1996, User's documentation for MODFLOW-96, an update to the U.S. Geological Survey modular finite-difference ground-water flow model: U.S. Geological Survey Open-File Report 96-485, 63 p.
Harbaugh, A.W., and McDonald, M.G., 1996, Programmer's documentation for MODFLOW-96, an update to the U.S. Geological Survey modular finite-difference ground-water flow model: U.S. Geological Survey Open-File Report 96-486, 228 p.
Leake, S.A., and Lilly, M.R., 1997, Documentation of a computer program (FHB1) for assignment of transient specified-flow and specified-head boundaries in applications of the modular finite- difference ground- water flow model (MODFLOW): U.S. Geological Survey Open- File Report 97-571, 56 p.
Fenske, J.P., Leake, S.A., and Prudic, D.E., 1996, Documentation of a computer program (RES1) to simulate leakage from reservoirs using the modular finite- difference ground-water flow model (MODFLOW): U.S. Geological Survey Open-File Report 96-364, 58 p.
Hsieh, P.A., and Freckleton, J.R., 1993, Documentation of a computer program to simulate horizontal-flow barriers using the U.S. Geological Survey modular three- dimensional finite-difference ground-water flow model: U.S. Geological Survey Open-File Report 92-477, 38 p.
Harbaugh, A.W., 1995, Direct solution package based on alternating diagonal ordering for the U.S. Geological Survey modular finite-difference ground-water flow model: U.S. Geological Survey Open-File Report 95-288, 52 p.
Leake, S.A., and Prudic, D.E., 1991, Documentation of a computer program to simulate aquifer-system compaction using the modular finite-difference ground-water flow model: U.S. Geological Survey Techniques of Water- Resources Investigations, book 6, chap. A2, 74 p. (IBS and CHD packages).

McDonald, M.G., and Harbaugh, A.W., 1988, A modular three-dimensional finite-difference ground-water flow model: U.S. Geological Survey Techniques of Water-Resources Investigations, book 6, chap. A1, 588 p.

Hill, M.C., 1990, Preconditioned conjugate-gradient 2 (PCG2), a computer program for solving ground-water flow equations: U.S. Geological Survey Water-Resources Investigations Report 90-4048, 31 p.

O. E. Strack and Frank D. Strack, *A Tutorial to Mlaem and Slaem*, 1997, Strack Consulting, Inc., North Oaks, MN, 77 p.

M. Bakker, *Simulating groundwater flow in multi-aquifer systems with analytical and numerical Dupuit-models*, Journal of Hydrology 222 (1999) 55-64, www.elsevier.com/locate/jhydrol, New York, NY.

M. Bakker, E.I. Anderson, T.N. Olsthoorn, O.D.L. Strack, *Regional groundwater modeling of the Yucca Mountain site using analytic elements*, Journal of Hydrology 226 (1999) 167-178, www.elsevier.com/locate/jhydrol, New York, NY.

M. Bakker, *Two exact solutions for a cylindrical inhomogeneity in a multi-aquifer system*, Advances in Water Resources 25 (2002) 9-18, www.elsevier.com/locate/advwatres, New York, NY.

Mark Bakker, Erik I. Anderson, *Comment on "Numerical investigation of lake bed seepage patterns: effects of porous medium and lake properties"* by Genereux, D., and Bandopadhyay, I. 2001. Journal of Hydrology 241 289-303, www.elsevier.com/locate/jhydrol, New York, NY.

Mark Bakker, Kick Hemker, *A Dupuit formulation for flow in layered, anisotropic aquifers*, Advances in Water Resources 25 (2002 747-754, www.elsevier.com/locate/advwatres, New York, NY.

Mark Bakker, *An analytic, approximate method for modeling steady, three-dimensional flow to partially penetrating wells*, Water Resources Research, vol. 37, No. 5, pp. 1301-1308, May 2001, Athens, Georgia.

* cited by examiner

Layout of line-sink elements in a collector well

BESSEL ANALYTIC ELEMENT SYSTEM AND METHOD FOR COLLECTOR WELL PLACEMENT

This application claims benefit of U.S. Provisional Patent Application No. 60/540,728 filed Jan. 30, 2004.

SOURCE CODE APPENDIX

This application includes a computer software specification listing appendix submitted with the aforementioned U.S. Provisional Patent Application No. 60/540,728 filed Jan. 30, 2004, the disclosure of which is incorporated by reference herein. A portion of the disclosure of this patent document contains material which is the subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of the Invention

The field of the invention is the computer modelling of steady-state groundwater flow in relation to collector wells, horizontal wells and galleries.

2. Description of the Related Art

A horizontal collector well is a well that is constructed by building a caisson that penetrates much of the vertical extent of an aquifer, then extending "lateral arms", constructed of perforated pipe or wound well screens, into the aquifer. Compared to a traditional vertical well, a horizontal collector well provides much larger pumping capacity with less drawdown in head. Furthermore, the lateral arms of a horizontal collector well can be built very close to (or even underneath) surface waters, increasing the ability of the well to induce aquifer recharge from surface waters. As a result, collector wells and horizontal wells are commonly used in public drinking water supply or industrial water supply applications.

In water resource planning, it is important to understand the source of groundwater that is moving to wells, to be able to predict the quantity of water that can be removed from an aquifer system, to predict the effects of new groundwater development on existing facilities, and to understand the potential for contamination of well water. Computer models of groundwater flow are commonly used in these applications, but collector wells pose a particularly challenging problem. Since the amount of water that can be abstracted by a collector well is large, its effects on groundwater flow are expressed over a large regional extent; however, the performance of the collector well is greatly influenced by local factors, such as three-dimensional flow in porous media, resistance to flow into and out of surface waters, and head losses resulting from flow into the lateral arms and within the lateral arms.

We are aware of only a few published computational models of collector wells. In general, the prior art can be separated into three categories: (1) numerical models based on finite-difference or finite-element approximations; (2) fully three-dimensional models using analytical solutions; and (3) approximate two-dimensional solutions.

Finite-Difference and Finite-Element Approximations

A variety of numerical methods have been employed to simulate groundwater flow to collector wells. Many collector wells have been modelled by consultant with finite difference techniques (e.g., Sonoma County Water Agency, Louisville Water Company) but in each case the models are necessarily limited in the representation of regional flow, or in the representation of the near field conditions near the lateral arms of the collector.

EXAMPLE 1

Danicic, D. and R. Long, 2003. Groundwater Modelling: Infrastructure Planning for Well Field Expansion, presented at the Pacific NorthWest AWWA Section meeting.

Their model was built to evaluate options for developing a new source of supply for the City of Newberg, Oreg. The city well field is situated along the Willamette River in the sand and gravel outwash aquifer. They used a finite element model of groundwater flow (MICRO-FEM) to simulate flow near the well and into the area around the well field.

EXAMPLE 2

Cunningham, W. L., E. S. Bair, and W. P. Yost. 1995. Hydrogeology and Simulation of Ground-Water Flow at the South Well Field, Columbus, Ohio. USGS. WRI-95-4279.

The three-dimensional, ground-water-flow model was constructed by use of the U.S. Geological Survey three-dimensional finite-difference ground-water-flow code. Recharge, boundary flux, and river leakage are the principal sources of water to the flow system. The study area is bounded on the north and south by streamlines, with flow entering the area from the east and west.

The numerical model contains 53 rows, 45 columns, and 3 layers. The uppermost two layers represent the glacial drift. The bottom layer represents the carbonate bedrock. The horizontal model grid is variably spaced to account for differences in available data and to simulate heads accurately in specific areas of interest. The length and width of grid cells range from 200 to 2,000 feet; the finer spacings are designed to increase detail in the areas near the collector wells. The model was developed to identify the contributing recharge area of the well and to consider the effects of low flows on yield.

EXAMPLE 3

FISHTRAP ISLAND COLLECTOR WELL, City of Prince George, Canada. Golder and Associates. 2003. Capture Zone Analysis, Contaminant Inventory and Preliminary Groundwater, Monitoring Plan, City of Prince George, Canada Assessed environmental impact of a proposed collector well. Found none. http://www.eao.gov.bc.ca/epic/output/html/deploy/epic_document__209__15598.html.

EXAMPLE 4

Kim, G., Koo, J., Shim, J., Shon, J., and Lee, S., 1999. A study of methods to reduce groundwater contamination around a landfill in Korea. Journal of Environmental Hydrology. (7), paper 10. The contaminant transport model MT3D was used to simulate flow in a contaminated aquifer. The model was constructed to assess the feasibility of capturing contaminants leaching from a sanitary landfill towards streams along the perimeter of the area. Modelling was used to assess the relationship between the number of extraction wells and the capture efficiency of migrating contaminants in the aquifer. The authors modelled hypothetical barrier walls and an increasing number of radial collector wells (simulated with MODFLOW drain cells) to determine the costs of increasing fractions of the contaminant removal.

Fully three-dimensional models using analytical solutions

We are able to identify five primary sources of research and publication of work done to develop fully 3-dimensional solutions for a radial collector well. In chronological order they are:

EXAMPLE 1

Hantush, M. S. and I. S. Papadopulos, 1963, *Flow of Ground Water to Collector Wells (Closure)*. Proceedings, American Society of Civil Engineers,/Journal of the Hydraulics Division/, HY4, p. 225-227.

Hantush, M. S. and I. S. Papadopulos, 1962, *Flow of Ground Water to Collector Wells*. Proceedings, American Society of Civil Engineers, /Journal of the Hydraulics Division/, HY5, pp. 221-224.

EXAMPLE 2

Radojkovic M and Pecaric J. 1984. Three-Dimensional Boundary Element Model of Groundwater Flow to Ranney Wells. 1984, pp.4. 63-4. 75.

EXAMPLE 3

David Steward (currently at the University of Kansas) has published a fully three-dimensional solution in his Ph.D. dissertation (University of Minnesota).

EXAMPLE 4

Ken Luther (currently at Valparaiso University) has published a fully three-dimensional solution in an unconfined aquifer.

EXAMPLE 5

Hongbin Zhan (currently at Texas A&M University) has published a transient analysis for pumping-test type curves in horizontal wells.

Approximate two-dimensional analytic element solutions

We know of two published examples of a collector well models using analytic elements. Neither includes the flow inside the lateral arms.

EXAMPLE 1

Strack [1989] provides an illustration of a radial collector modeled with line-dipole elements.

EXAMPLE 2

GFLOW 2000 (Haitjema Software, LLC) supports a two-dimensional gallery element. Haitjema software provides a monograph explaining ways to estimate "effective resistance" parameters for horizontal wells.

In addition, Victor Kelson has implemented a two-dimensional prototype version of groundwater modelling code. This code includes entry resistance on the lateral arms and resistance to flow within the lateral arms.

None of the two-dimensional solutions account explicitly for the vertical resistance of the aquifer or stream-collector-aquifer interactions.

SUMMARY OF THE INVENTION

The present invention provides an efficient approximation to three dimensional simulation of groundwater flow in a series of collector wells by modelling both the layers of the groundwater environment and effectively calculating the leakage between layers. The local effects, the layers, are modelled by equations that are easily calculated, and the global effects in the groundwater system of the individual layers is easily integrated into a global perspective by the leakage between layers. In this manner, local conditions, specified by noting the boundary conditions of the line sinks of the lateral arms. The length of the arms and the sink densities are included in the modelling, as well as the friction analysis of the head loss. The resulting model may be solved for the pumping rate, in the case of a discharge-specified well, or the discharge rate, showing the potential yield of the well.

This invention is a practical computational model of groundwater flow to a collector well, horizontal well, or gallery. It will find applications in environmental science, civil and environmental engineering, water resource management, hydrology, and geology. The invention is a steady-state computer model of a horizontal collector well that makes use of "Bessel" analytic elements. The model also supports the simulation of horizontal wells and galleries. The horizontal collector well model is a module that has been added to the Bessel analytic element code TimML [Bakker, 2003]. TimML is a computational code written in the Python language that has been released to the public under the GNU LGPL license.

The principles of modelling groundwater flow using the analytic element method are published elsewhere [e.g. Strack, 1989; Haitjema,1995]. "Bessel" analytic elements are analytical solutions to groundwater flow that include leakage to and from adjoining layers, e.g. in semiconfined aquifers. Bakker [2002, 2003] has developed a practical computer code that simulates steady-state, quasi-three-dimensional groundwater flow using Bessel analytic elements. In this code, the aquifer(s) are represented by horizontal "slices", each a continuum of piecewise-constant properties. The problem formulation separates the groundwater flow problem into two parts: (1) a harmonic solution that can be solved using "traditional" analytic elements (e.g. after Strack [1989]); and (2) a non-harmonic leakage solution that may be solved using Bessel analytic elements. Bakker [2002] has demonstrated an accurate solution for groundwater flow to a partially-penetrating well in a confined aquifer using Bessel analytic elements.

This invention applies the Bessel analytic element model TimML to explicitly simulate flow to collector wells, horizontal wells, and galleries. This was accomplished by:

1. Devising a strategy for arranging an array of line-sink elements that represent the lateral arms of the collector well
2. Specifying boundary conditions for groundwater flow to the lateral arms, including the head losses due to flow into and within the lateral arms
3. Modifying the solution strategy of TimML to include an explicit procedure for updating the boundary conditions in (2).

The resulting model allows the simulation of all factors that affect the performance and effects of a horizontal collector well, horizontal well, or gallery. It improves on the prior art in the following ways:

Explicitly simulates the interactions between the collector well, nearby surface waters, and three-dimensional flow in porous media Can be efficiently included in a large-scale regional model, in order to account for the effects of the collector on neighboring wells and other water users Provides an analytically-accurate potentiometric head and velocity field Allows for accurate computation of streamlines and travel times for groundwater flow The invention improves on the prior art in the following ways:

Explicitly accounts for all aspects of collector well performance, including entry resistance and frictional resistance within the collector arms.

Explicitly accounts for vertical flow from surface waters to collectors by the use of a layered, Bessel analytic element formulation.

Makes it possible to "imbed" a fully explicit model of a collector well in a regional quasi-three-dimensional regional model, accounting for the regional effects of the collector.

Computationally efficient solution for the 3-D problem near the well.

This is the first application of Bessel analytic elements to the problem of modelling horizontal collector wells, horizontal wells, and galleries. This model improves on previous collector well models with line-sink elements: Manages the vertical flow that is ignored in the two-dimensional approximations, and includes vertical interactions between lateral arms and surface waters; Capable of solving general regional-scale problems that fully three-dimensional models cannot manage; and Includes features such as frictional head losses within lateral arms. We claim that this model improves on previous collector well models based on finite-difference and finite-element formulations: Explicitly represents the geometry of the collector well; and Includes features such as frictional head losses within lateral arms.

BRIEF DESCRIPTION OF THE DRAWINGS

The above-mentioned and other features and objects of this invention, and the manner of attaining them, will become more apparent and the invention itself will be better understood by reference to the following description of embodiments of the invention taken in conjunction with the accompanying drawings, wherein.

Figure 1:
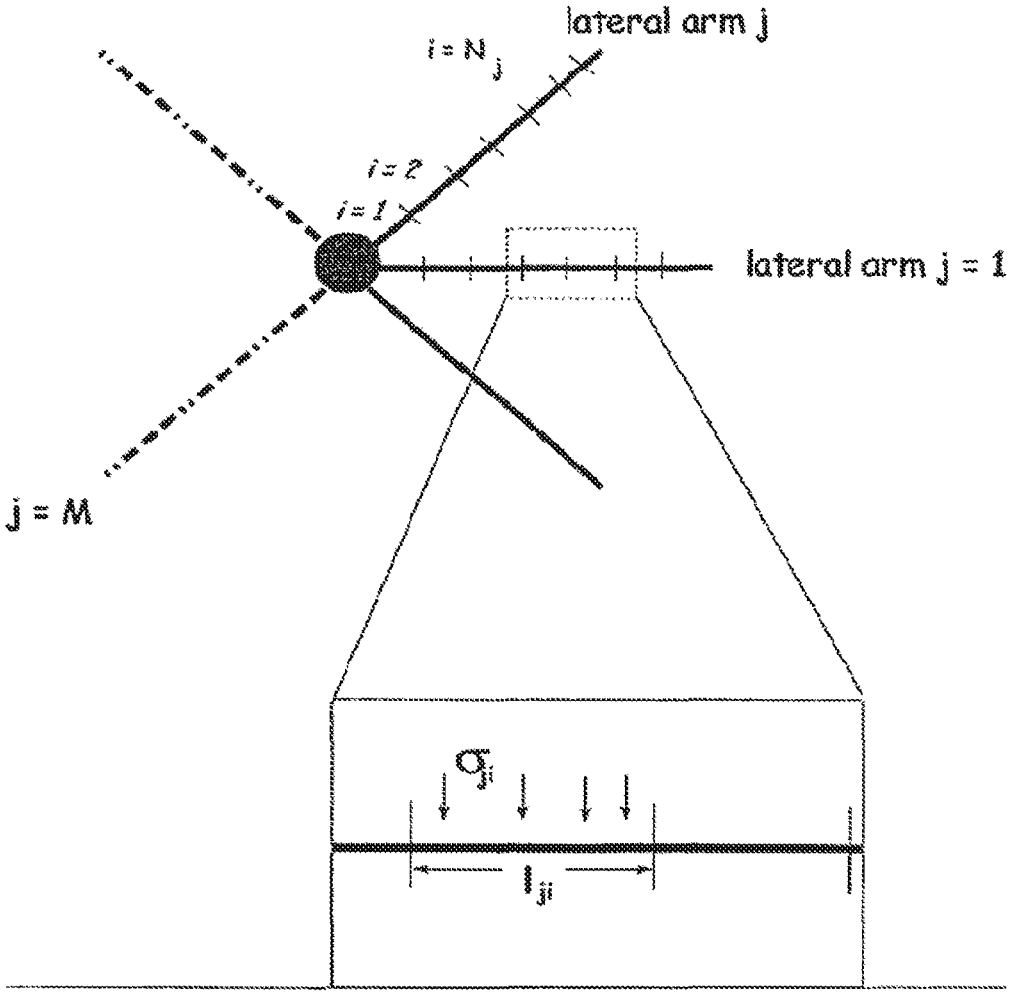
FIG. 1 is a schematic representation of line-sink elements in a collector well.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention in several forms and such exemplification is not to be construed as limiting the scope of the invention in any manner.

DESCRIPTION OF INVENTION

The collector well is modelled as a collection of line-sink elements as follows. Consider the collector well in FIG. 1 The collector well is composed of M lateral arms. For lateral arm j; j=1 . . . M, the arm length is $L_j$ the radius of the arm is $r_j$, and the lateral arm is located in model layer $k_j$. We divide each lateral arm j into $N_j$ segments. For segment i of lateral arm j (where i=1 at the caisson), the segment length $l_{ji}$ is computed as $$l_{ji} = L_j \times \frac{N_j - i + 1}{S_j} \quad \text{where} \tag{1}$$

$$S_j = \sum i_{i=1}^{Nj} \tag{2}$$

This arrangement results in shorter line-sinks at the tips of the lateral arms, and improves the accuracy of the solution. Each line-sink element has a sink density (in volume of water per day per unit length) of $\sigma_{ji}$, and the head in the aquifer at all points near the collector well is a priori unknown. The modeller provides an entry resistance $c_{ji}$ at each line-sink, which accounts for the head loss that may occur as water moves from the aquifer into the lateral arm through the well screen or any fine materials that may collect there in the aquifer (commonly referred to as a "skin" effect). We place a collocation point at the center of each line-sink($x_{ji}$, $y_{ji}$) where the boundary conditions are to be met. At the collocation point for segment i of lateral arm j, the sink density may be written as $$\sigma_{ji} = \frac{2\pi r_j}{c_{ji}}(\phi_{aquifer} - \phi_{lateral}) \tag{3}$$

where $\phi_{aquifer}$ is the head outside the lateral arm and $\phi_{lateral}$ is the head inside the lateral arm at the collocation point. This expression may be solved for the head in the lateral, $$\phi_{lateral} = \phi_{aquifer} - \frac{\sigma_{ji} c_{ji}}{2\pi r_j} \tag{4}$$

In TimML, calculations are performed in terms of "discharge potentials". The discharge potential Φ in layer k is defined as $$\Phi_k = T_k \phi_k \tag{5}$$

where $T_k$ is the transmissivity of layer k and $\Phi_k$ is the head in layer k. The contribution of line-sink element i of lateral arm j to the potential at any location (x, y) in layer k is computed by multiplying the sink density $\sigma_{ji}$ by an influence function $F_{ji}$(x, y, k), which is provided in Bakker. At the collocation point ($x_{ji}$, $y_{ji}$), the total potential is computed as:

$$\Phi(x_{ji}, y_{ji}, k_j) = \sum_{J=1}^{M} \sum_{l=1}^{Nj} \sigma_{Jl} F_{Jl}(x_{ji}, y_{ji}, k_j) + \Phi_{\text{other}} \tag{6}$$

where $\Phi_{other}$ is the sum of the potential contributions of all other elements in the model. Combining 4 with 6 and recalling the definition of the discharge potential 5 yields the following expression for the head in the lateral, $$\phi_{lateral}(x_{ji}, y_{ji}, k_j) = \frac{1}{T_{kj}} \sum_{J=1}^{M} \sum_{l=1}^{N_j} \sigma_{Jl} F_{Jl}(x_{ji}, y_{ji}, k_j) + \Phi_{other} - \frac{\sigma_{ji} c_{ji}}{2\pi r_j} \tag{7}$$

Expression 7 yields $\Sigma_{j=1}^{M} N_j$ equations for the $\Sigma_{j=1}^{M} N_j$ unknown values $\sigma_{ji}$. We write these equations as follows:

At the caisson, the heads in all laterals are equal. For all laterals except the first lateral (J>1), we write the boundary conditions as $$\phi_{lateral}(x_{j1}, y_{j1}, k_j) = \phi_{lateral}(x_{11}, y_{11}, k_1) \tag{8}$$

This yields M−1 equations.

At all control points along lateral arms (i>1), the difference in head along the arms between adjoining control points, is a function of the total amount of in the arm at the control point, $$\phi_{lateral}(x_{ji}, y_{ji}, k_j) - \phi_{lateral}(x_{ji}, -1, y_{ji}-l, j_j) = f(Q_{ji}, \phi_{lateral}(x_{ji}, y_{ji}, k_j)) \tag{9}$$

Where the total flow in the arm, $Q_{ji}$ is computed from the lengths and sink densities of the line-sink elements for the lateral arm, $$Q_{ji} = \sum_{l=i}^{Nj} \sigma_{jl} l_{jl} \tag{10}$$

For the collector well model, the function $f$ is based on a Moody friction factor which is provided by the modeller, based on the material that comprises the lateral arm. If an improved expression for the head loss along the arm is available, it may be substituted in the computer code, e.g. a channel-flow expression will be used for galleries.

This yields $\Sigma_{j=1}^{M} N_j - 1$ equations.

The final equation can be provided in either of two forms: (1) the modeller provides the pumping rate (discharge-specified well); or (2) the modeller provides the head in the caisson (head-specified well). Case (2) is to be used when the modeller desires to know the possible yield of the collector well. These boundary conditions are as follows.

Discharge-Specified Condition

The discharge-specified condition is $$\phi_{lateral}(x_{11}, y_{11}, k_1) = Q_w \tag{3}$$

where $Q_w$ is the total pumping rate of the well.

Head-specified Condition

The head-specified condition is $$\phi_{lateral}(x_{11}, y_{11}, k_1) = \phi_w \tag{12}$$

where $\phi_w$ is the specified head in the caisson.

Solution Strategy

The friction-loss equations in 9 require that an iterative solution procedure be used. The model first pre-conditions the model with an initial estimate of all $\sigma_{ji}$, then computes initial estimates of the values $\varnothing_{lateral}(x_{ji}, y_{ji}, k_j)$-$\varnothing_{lateral}(x_{ji-1}, y_{ji-1}, j_j)$ using expressions 9 and 10. Now, a direct solution for all $\sigma_{ji}$ is performed using a full matrix solver. A Gauss-Seidel approach is used to improve the estimate of $\varnothing_{lateral}(x_{ji}, y_{ji}, k_j)$-$\varnothing_{lateral}(x_{ji-1}, y_{ji-1}, j_j)$, based on the improved values of $\sigma_{ji}$. For most problems, the solution converges in 3-4 Gauss-Seidel iterations.

Alternative friction-loss equations are also compatible with the present invention. For example, different soil, piping, filtering, and other configurations may point to a different friction-loss equation as being more suitable for a particular location or configuration. The exemplary embodiment of the invention uses a good general purpose friction-loss equation to provide reasonable modelling of the underlying conditions.

The process utilizing the present invention allows a planner to develop a model of groundwater flow within a well configuration. First, the planner specifies a geographic area in conjunction with one or more related wells. The planner then creates a mathematical model of groundwater flow in relation to the wells with a plurality of layers. Each layer has a local flow component and a leakage component defined by the planner. Using software according to the present invention, The layers are modified based on the leakage component of adjacent layers.

The planner may simulate groundwater flow to a collector well, horizontal well, or gallery by specifying an array of line-sink elements that represent the lateral arms of the collector well, horizontal well, or gallery. In order to effect such a simulation, the planner must also specify boundary conditions for groundwater flow to the lateral arms. Software may then calculate groundwater flows based on the array and boundary conditions. The present invention provides the aforementioned advantages by updating the boundary conditions during the calculation.

Each of the layers may have a model component related to frictional head loss specified by the planner so that calculations involving a component of each layer are related to that frictional head loss. The definition of the layers may include using the head losses due to flow into and within the lateral arms. The calculations may also involve discharge potentials. Finally, the calculations may specifying determining either the discharge-condition or a head specified condition.

Figure 2:
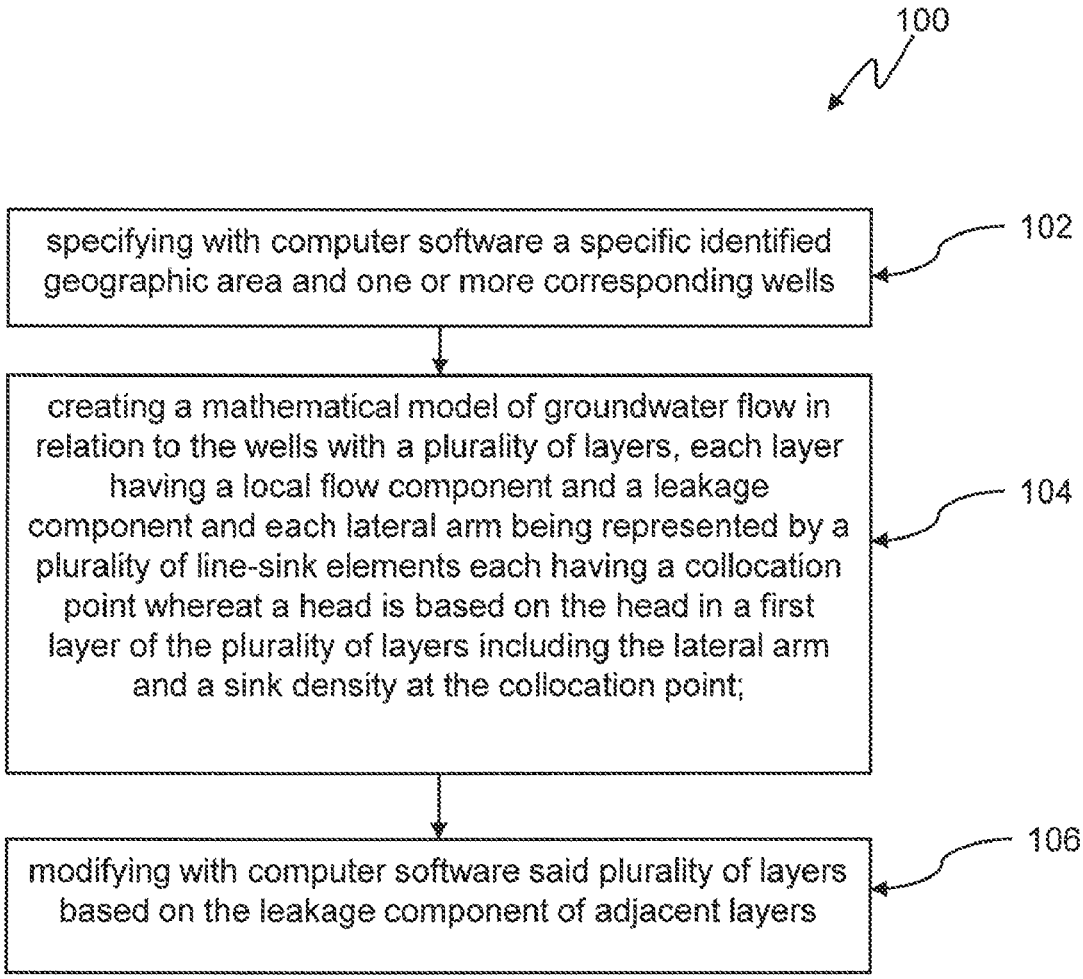
FIG. 2 illustrates a method of developing a model of groundwater flow with a well configuration.

Referring to FIG. 2, an exemplary computer implemented method 100 of developing a model of groundwater flow with a well configuration on a processor is illustrated. The method 110 including the step of specifying with computer software a specific identified geographic area and one or more corresponding wells, each well having a plurality of lateral arms connected to the well (as represented by block 112). The method 110 including the step of creating a mathematical model of groundwater flow in relation to the wells with a plurality of layers with computer software (as represented by block 114). Each layer having a local flow component and a leakage component. Each lateral arm being represented by a plurality of line-sink elements each having a collocation point whereat a head is based on the head in a first layer of the plurality of layers including the lateral arm and a sink density at the collocation point. The method 110 including the step of modifying with computer software said plurality of layers based on the leakage component of adjacent layers (as represented by block 116).

Figure 3:
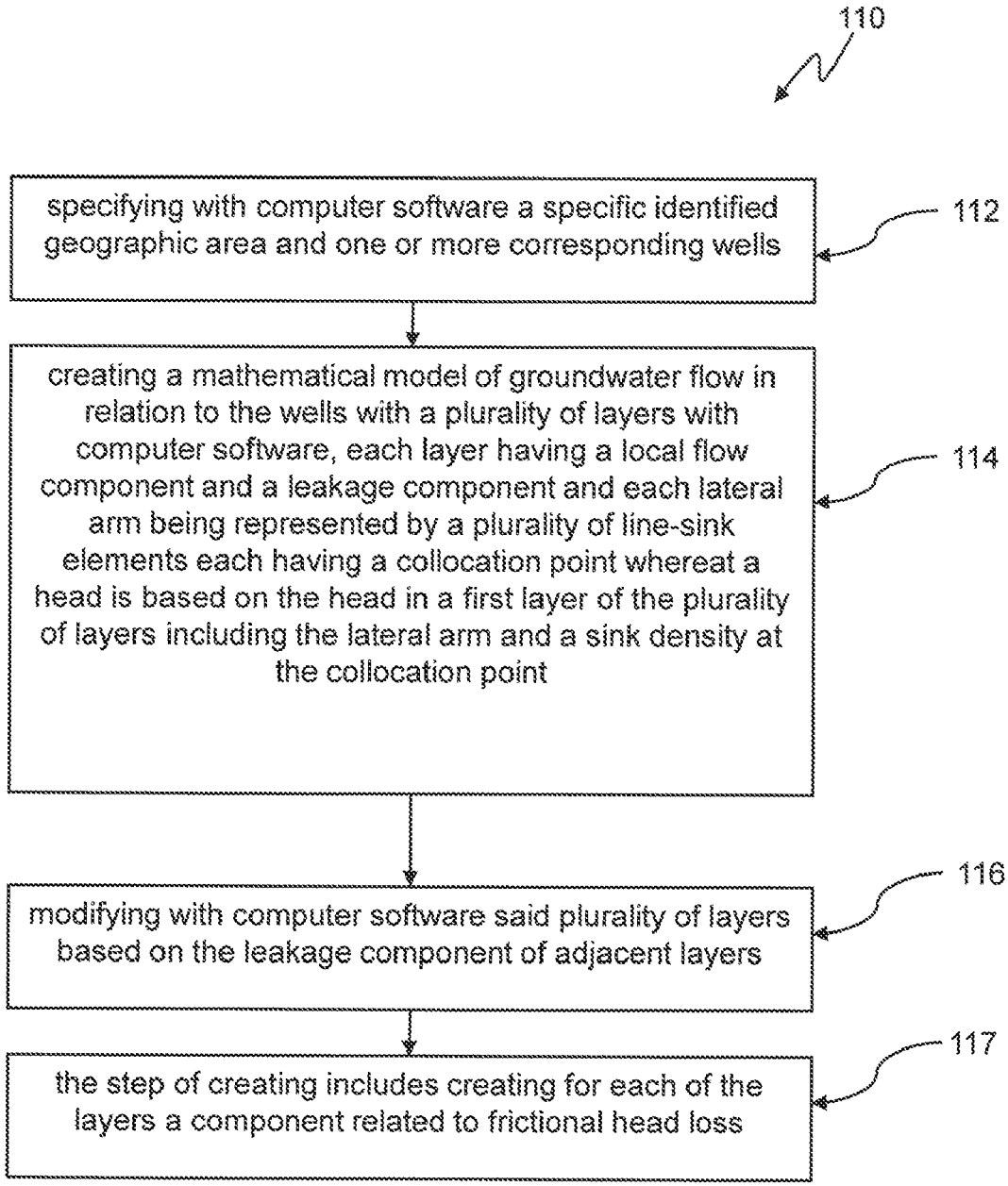
FIG. 3 illustrates a variation of the method of FIG. 2.

Referring to FIG. 3, an exemplary computer implemented method 110 of developing a model of groundwater flow with a well configuration on a processor is illustrated. The method 110 including the step of specifying with computer software a specific identified geographic area and one or more corresponding wells, each well having a plurality of lateral arms connected to the well (as represented by block 112). The method 110 including the step of creating a mathematical model of groundwater flow in relation to the wells with a plurality of layers with computer software (as represented by block 114). Each layer having a local flow component and a leakage component. Each lateral arm being represented by a plurality of line-sink elements each having a collocation point whereat a head is based on the head in a first layer of the plurality of layers including the lateral arm and a sink density at the collocation point. The method 110 including the step of modifying with computer software said plurality of layers based on the leakage component of adjacent layers (as represented by block 116). The step of creating includes creating for each of the layers a component related to frictional head loss (as represented by block 117).

Figure 4:
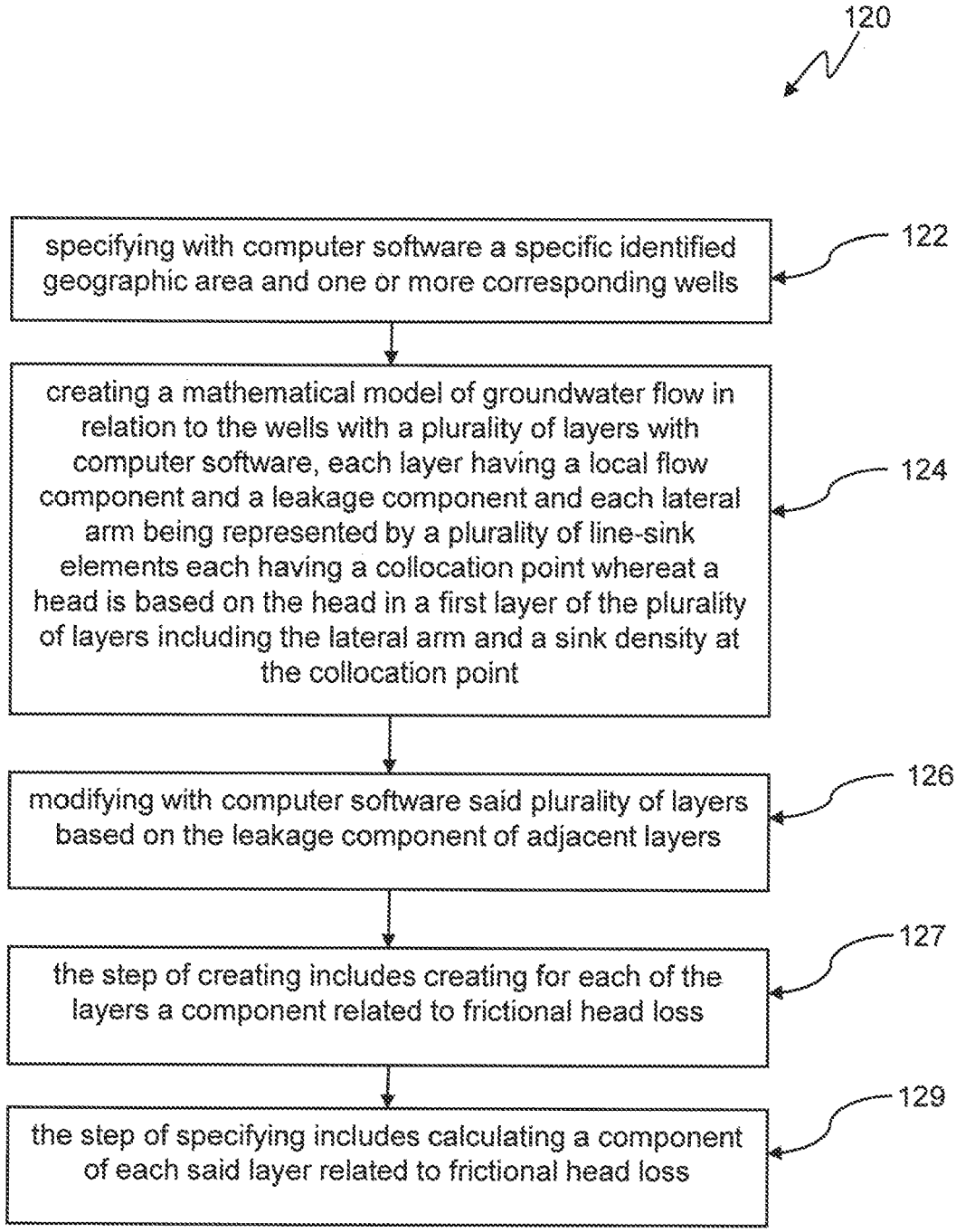
FIG. 4 illustrates a refinement of the method of FIG. 3.

Referring to FIG. 4, an exemplary computer implemented method 120 of developing a model of groundwater flow with a well configuration on a processor is illustrated. The method 120 including the step of specifying with computer software a specific identified geographic area and one or more corresponding wells, each well having a plurality of lateral arms connected to the well (as represented by block 122). The method 120 including the step of creating a mathematical model of groundwater flow in relation to the wells with a plurality of layers with computer software (as represented by block 124). Each layer having a local flow component and a leakage component. Each lateral arm being represented by a plurality of line-sink elements each having a collocation point whereat a head is based on the head in a first layer of the plurality of layers including the lateral arm and a sink density at the collocation point. The method 120 including the step of modifying with computer software said plurality of layers based on the leakage component of adjacent layers (as represented by block 126). The step of creating includes creating for each of the layers a component related to frictional head loss (as represented by block 127). The step of specifying includes calculating a component of each said layer related to frictional head loss (as represented by block 129).

Figure 5:
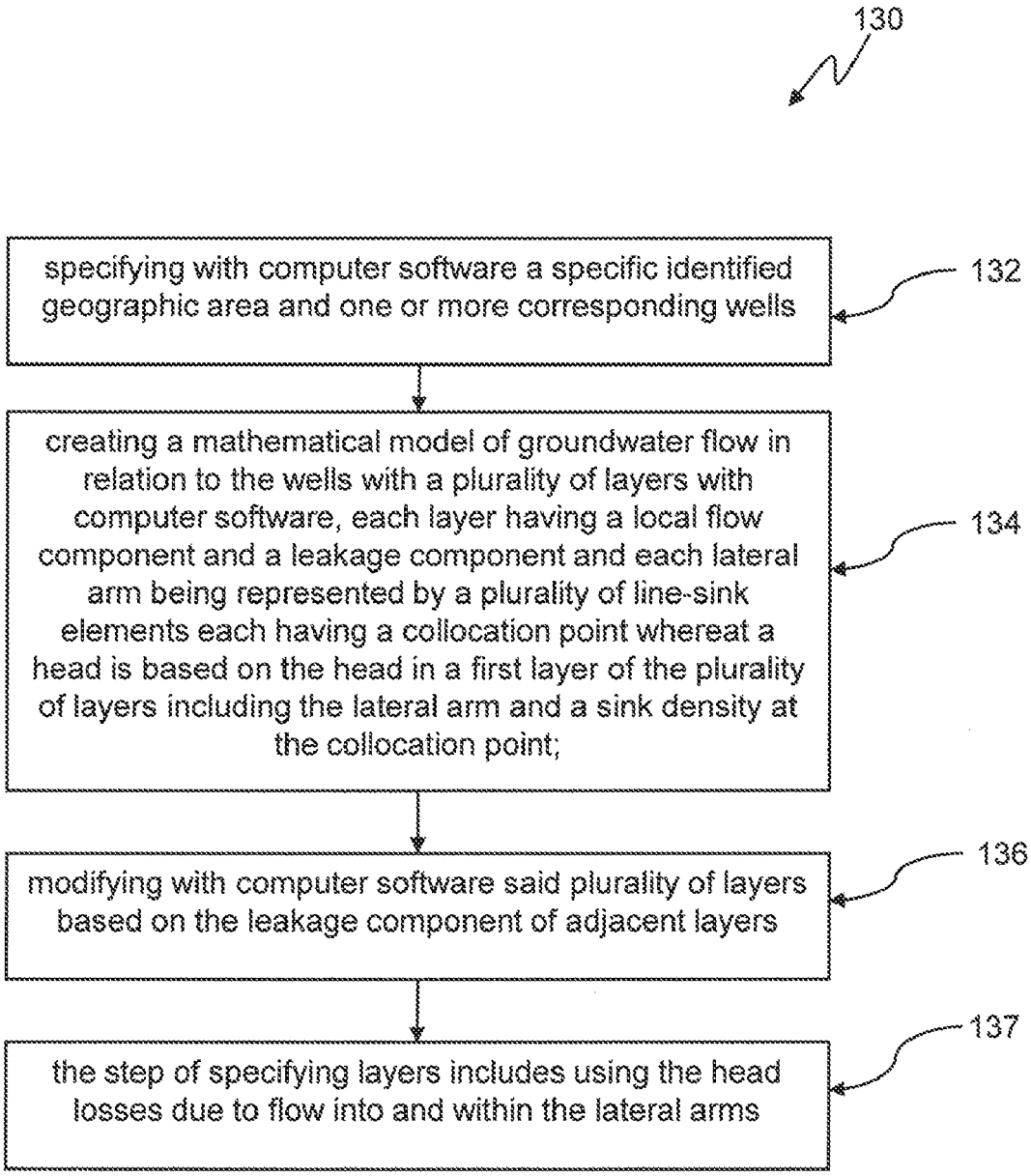
FIG. 5 illustrates a variation of the method of FIG. 2.

Referring to FIG. 5, an exemplary computer implemented method 130 of developing a model of groundwater flow with a well configuration on a processor is illustrated. The method 130 including the step of specifying with computer software a specific identified geographic area and one or more corresponding wells, each well having a plurality of lateral arms connected to the well (as represented by block 132). The method 130 including the step of creating a mathematical model of groundwater flow in relation to the wells with a plurality of layers with computer software (as represented by block 134). Each layer having a local flow component and a leakage component. Each lateral arm being represented by a plurality of line-sink elements each having a collocation point whereat a head is based on the head in a first layer of the plurality of layers including the lateral arm and a sink density at the collocation point. The method 130 including the step of modifying with computer software said plurality of layers based on the leakage component of adjacent layers (as represented by block 136). The step of specifying layers includes using the head losses due to flow into and within the lateral arms (as represented by block 137).

Figure 6:
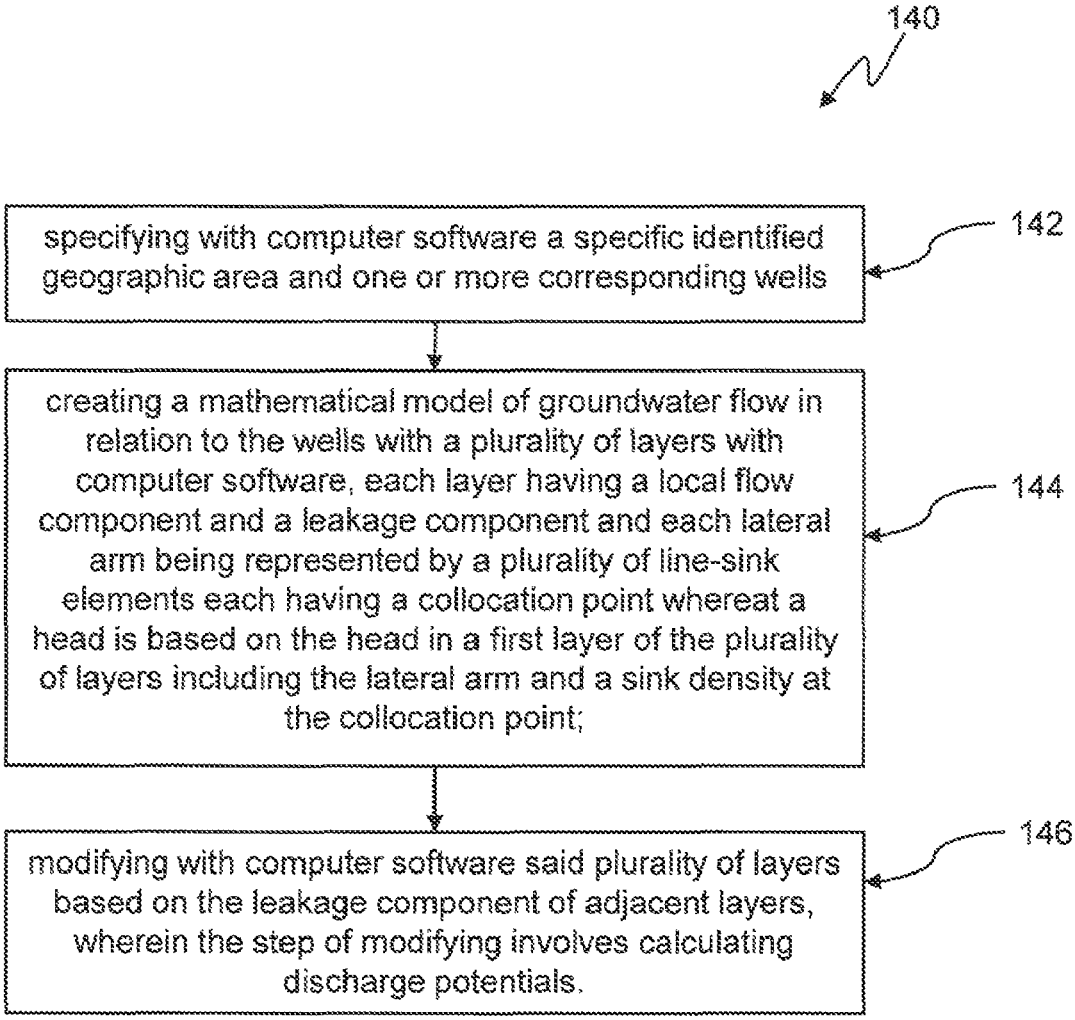
FIG. 6 illustrates a variation of the method of FIG. 2.

Referring to FIG. 6, an exemplary computer implemented method 140 of developing a model of groundwater flow with a well configuration on a processor is illustrated. The method 140 including the step of specifying with computer software a specific identified geographic area and one or more corresponding wells, each well having a plurality of lateral arms connected to the well (as represented by block 142). The method 140 including the step of creating a mathematical model of groundwater flow in relation to the wells with a plurality of layers with computer software (as represented by block 144). Each layer having a local flow component and a leakage component. Each lateral arm being represented by a plurality of line-sink elements each having a collocation point whereat a head is based on the head in a first layer of the plurality of layers including the lateral arm and a sink density at the collocation point. The method 140 including the step of modifying with computer software said plurality of layers based on the leakage component of adjacent layers (as represented by block 146). The step of modifying involves calculating discharge potentials.

Figure 7:
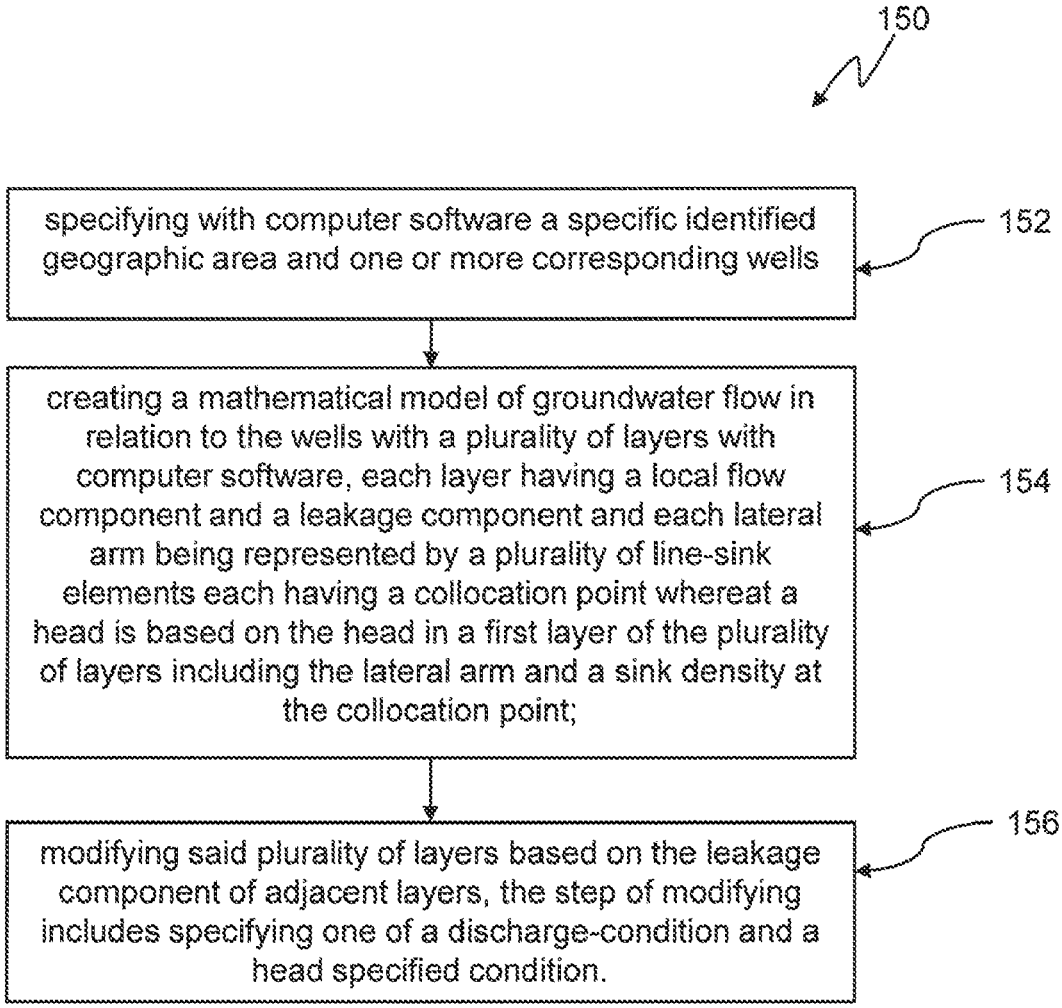
FIG. 7 illustrates a variation of the method of FIG. 2.

Referring to FIG. 7, an exemplary computer implemented method 150 of developing a model of groundwater flow with a well configuration on a processor is illustrated. The method 150 including the step of specifying with computer software a specific identified geographic area and one or more corresponding wells, each well having a plurality of lateral arms connected to the well (as represented by block 152). The method 150 including the step of creating a mathematical model of groundwater flow in relation to the wells with a plurality of layers with computer software (as represented by block 154). Each layer having a local flow component and a leakage component. Each lateral arm being represented by a plurality of line-sink elements each having a collocation point whereat a head is based on the head in a first layer of the plurality of layers including the lateral arm and a sink density at the collocation point. The method 150 including the step of modifying with computer software said plurality of layers based on the leakage component of adjacent layers (as represented by block 156). The step of modifying includes specifying one of a discharge-condition and a head specified condition.

Figure 8:
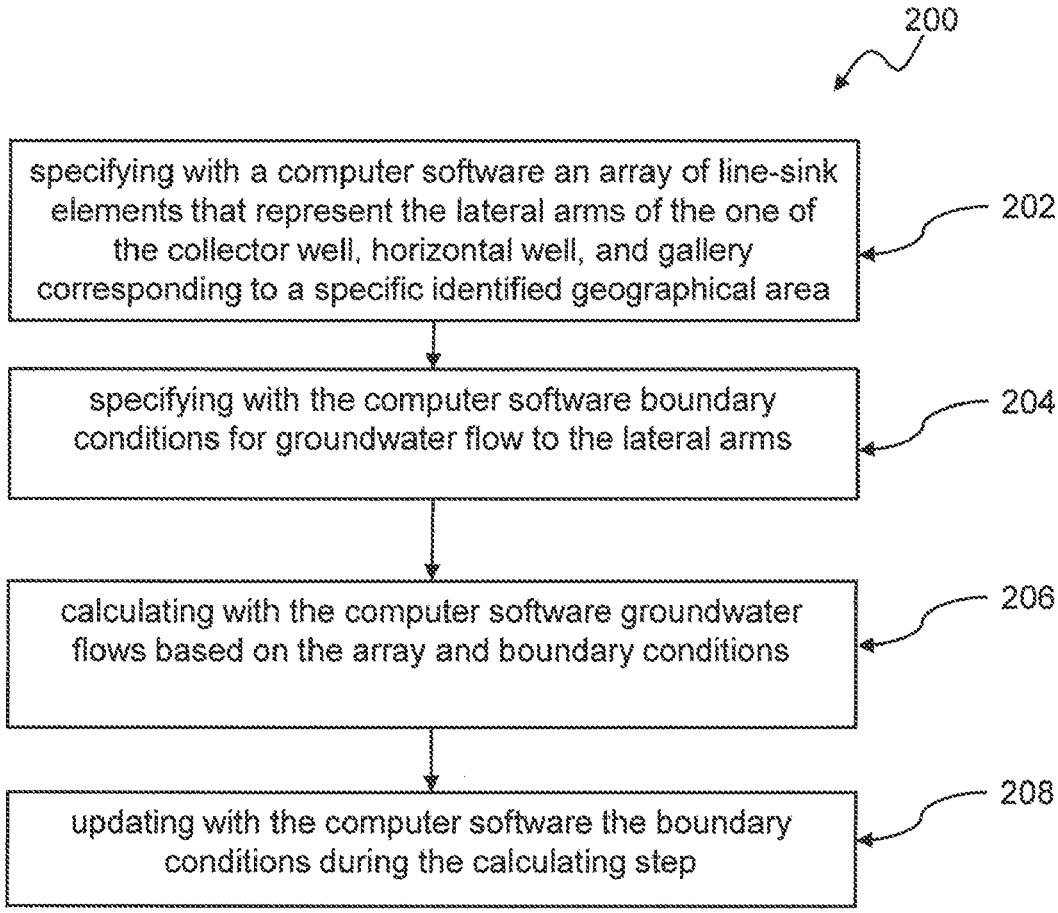
FIG. 8 illustrates a method of simulating groundwater flow to one of a collector well, horizontal well, and gallery.

Referring to FIG. 8, an exemplary computer implemented method 200 of simulating groundwater flow to one of a collector well, horizontal well, and gallery on a processor is illustrated. The method 200 including the step of specifying with a computer software an array of line-sink elements that represent the lateral arms of the one of the collector well, horizontal well, and gallery corresponding to a specific identified geographical area (as represented by block 202). The method 200 including the step of specifying with the computer software boundary conditions for groundwater flow to the lateral arms (as represented by block 204). The method 200 including the step of calculating with the computer software groundwater flows based on the array and boundary conditions (as represented by block 206). The method 200 including the step of updating with the computer software the boundary conditions during the calculating step (as represented by block 208).

Figure 9:
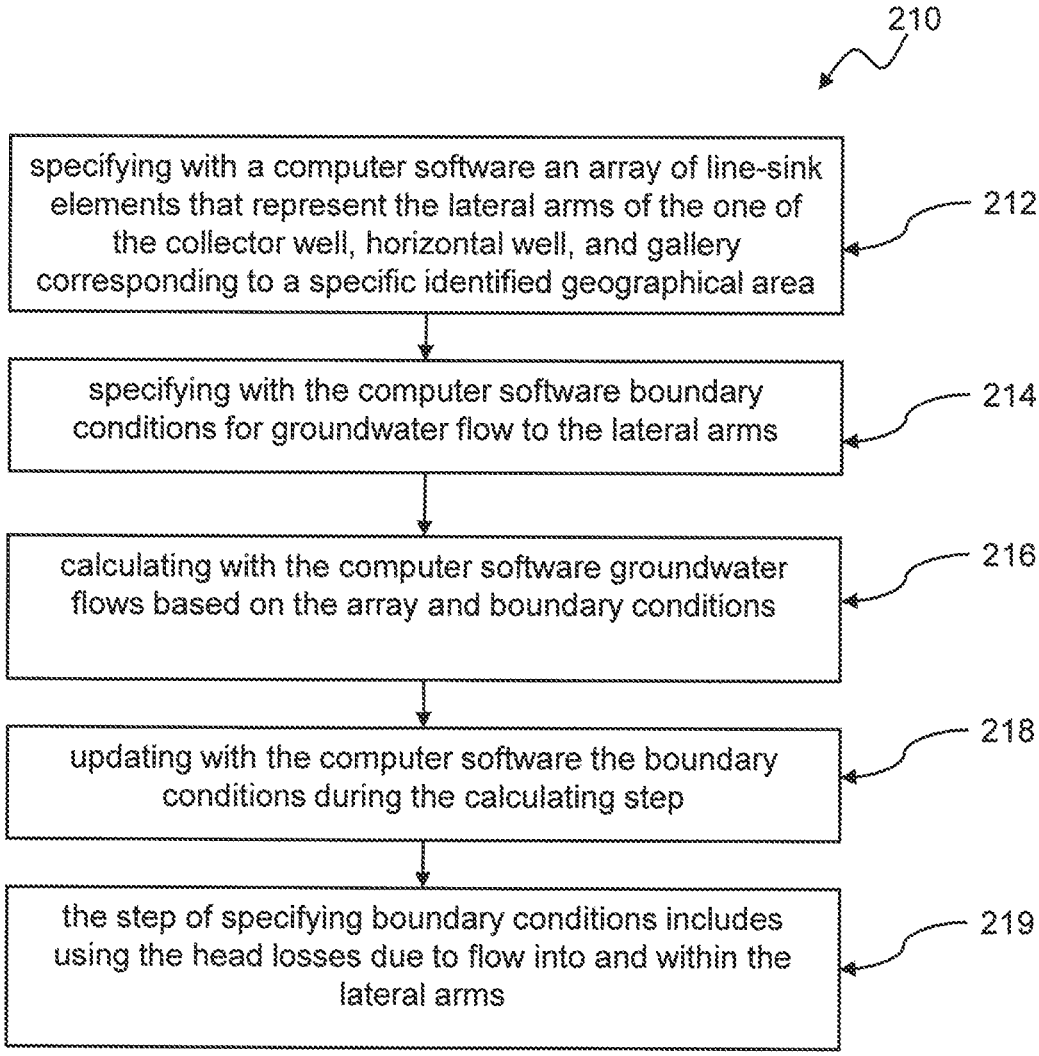
FIG. 9 illustrates a variation of the method of FIG. 8.

Referring to FIG. 9, an exemplary computer implemented method 210 of simulating groundwater flow to one of a collector well, horizontal well, and gallery on a processor is illustrated. The method 210 including the step of specifying with a computer software an array of line-sink elements that represent the lateral arms of the one of the collector well, horizontal well, and gallery corresponding to a specific identified geographical area (as represented by block 212). The method 210 including the step of specifying with the computer software boundary conditions for groundwater flow to the lateral arms (as represented by block 214). The method 210 including the step of calculating with the computer software groundwater flows based on the array and boundary conditions (as represented by block 216). The method 210 including the step of updating with the computer software the boundary conditions during the calculating step (as represented by block 218). The step of specifying boundary conditions includes using the head losses due to flow into and within the lateral arms (as represented by block 219).

Figure 10:
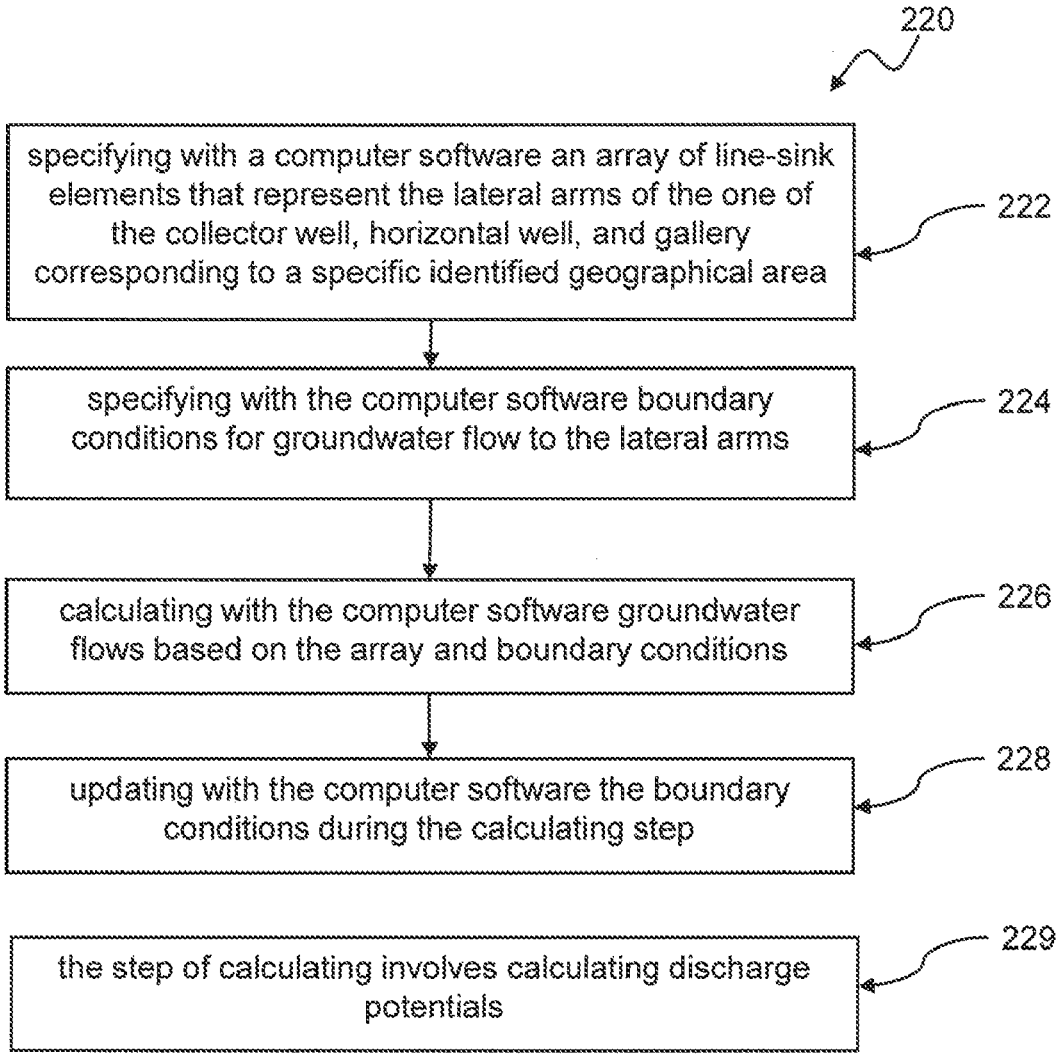
FIG. 10 illustrates a variation of the method of FIG. 8.

Referring to FIG. 10, an exemplary computer implemented method 220 of simulating groundwater flow to one of a collector well, horizontal well, and gallery on a processor is illustrated. The method 220 including the step of specifying with a computer software an array of line-sink elements that represent the lateral arms of the one of the collector well, horizontal well, and gallery corresponding to a specific identified geographical area (as represented by block 222). The method 220 including the step of specifying with the computer software boundary conditions for groundwater flow to the lateral arms (as represented by block 224). The method 220 including the step of calculating with the computer software groundwater flows based on the array and boundary conditions (as represented by block 226). The method 220 including the step of updating with the computer software the boundary conditions during the calculating step (as represented by block 228). The step of calculating involves calculating discharge potentials (as represented by block 229).

Figure 11:
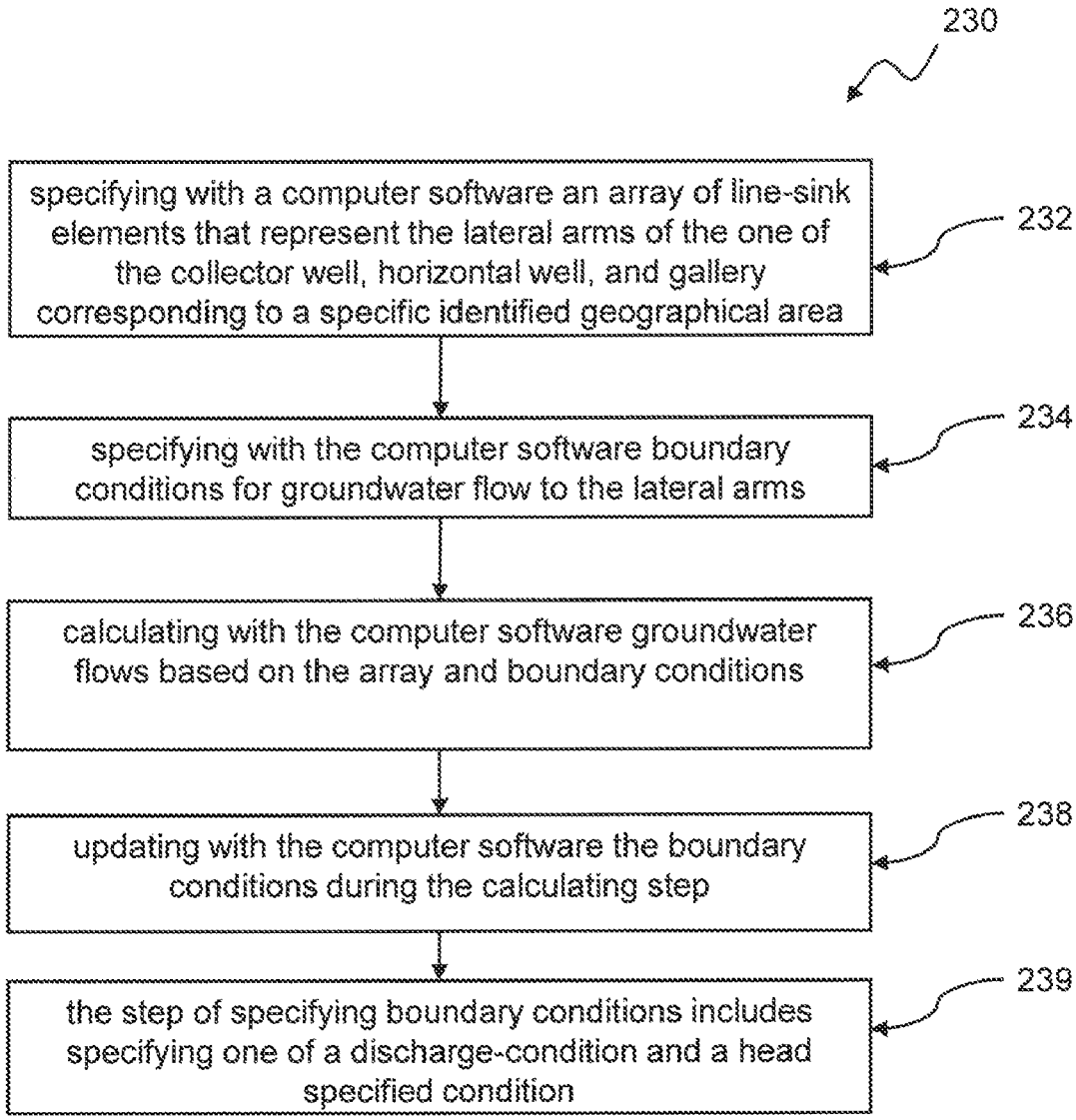
FIG. 11 illustrates a variation of the method of FIG. 8.

Referring to FIG. 11, an exemplary computer implemented method 230 of simulating groundwater flow to one of a collector well, horizontal well, and gallery on a processor is illustrated. The method 230 including the step of specifying with a computer software an array of line-sink elements that represent the lateral arms of the one of the collector well, horizontal well, and gallery corresponding to a specific identified geographical area (as represented by block 232). The method 230 including the step of specifying with the computer software boundary conditions for groundwater flow to the lateral arms (as represented by block 234). The method 230 including the step of calculating with the computer software groundwater flows based on the array and boundary conditions (as represented by block 236). The method 200 including the step of updating with the computer software the boundary conditions during the calculating step (as represented by block 238). The step of specifying boundary conditions includes specifying one of a discharge-condition and a head specified condition (as represented by block 239).

Figure 12:
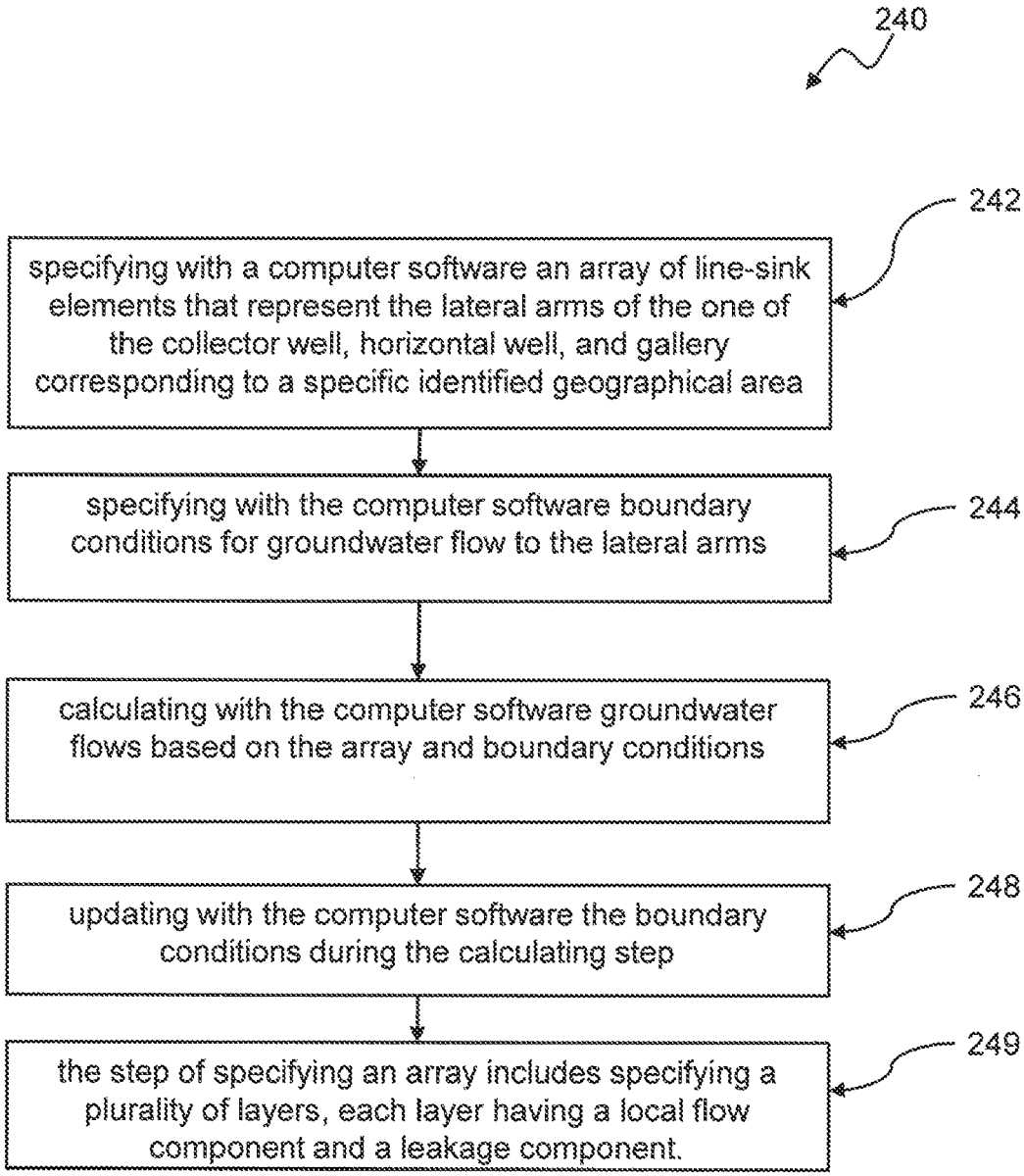
FIG. 12 illustrates a variation of the method of FIG. 8.

Referring to FIG. 12, an exemplary computer implemented method 240 of simulating groundwater flow to one of a collector well, horizontal well, and gallery on a processor is illustrated. The method 240 including the step of specifying with a computer software an array of line-sink elements that represent the lateral arms of the one of the collector well, horizontal well, and gallery corresponding to a specific identified geographical area (as represented by block 242). The method 240 including the step of specifying with the computer software boundary conditions for groundwater flow to the lateral arms (as represented by block 244). The method 240 including the step of calculating with the computer software groundwater flows based on the array and boundary conditions (as represented by block 246). The method 240 including the step of updating with the computer software the boundary conditions during the calculating step (as represented by block 248). The step of specifying an array includes specifying a plurality of layers, each layer having a local flow component and a leakage component (as represented by block 249).

Figure 13:
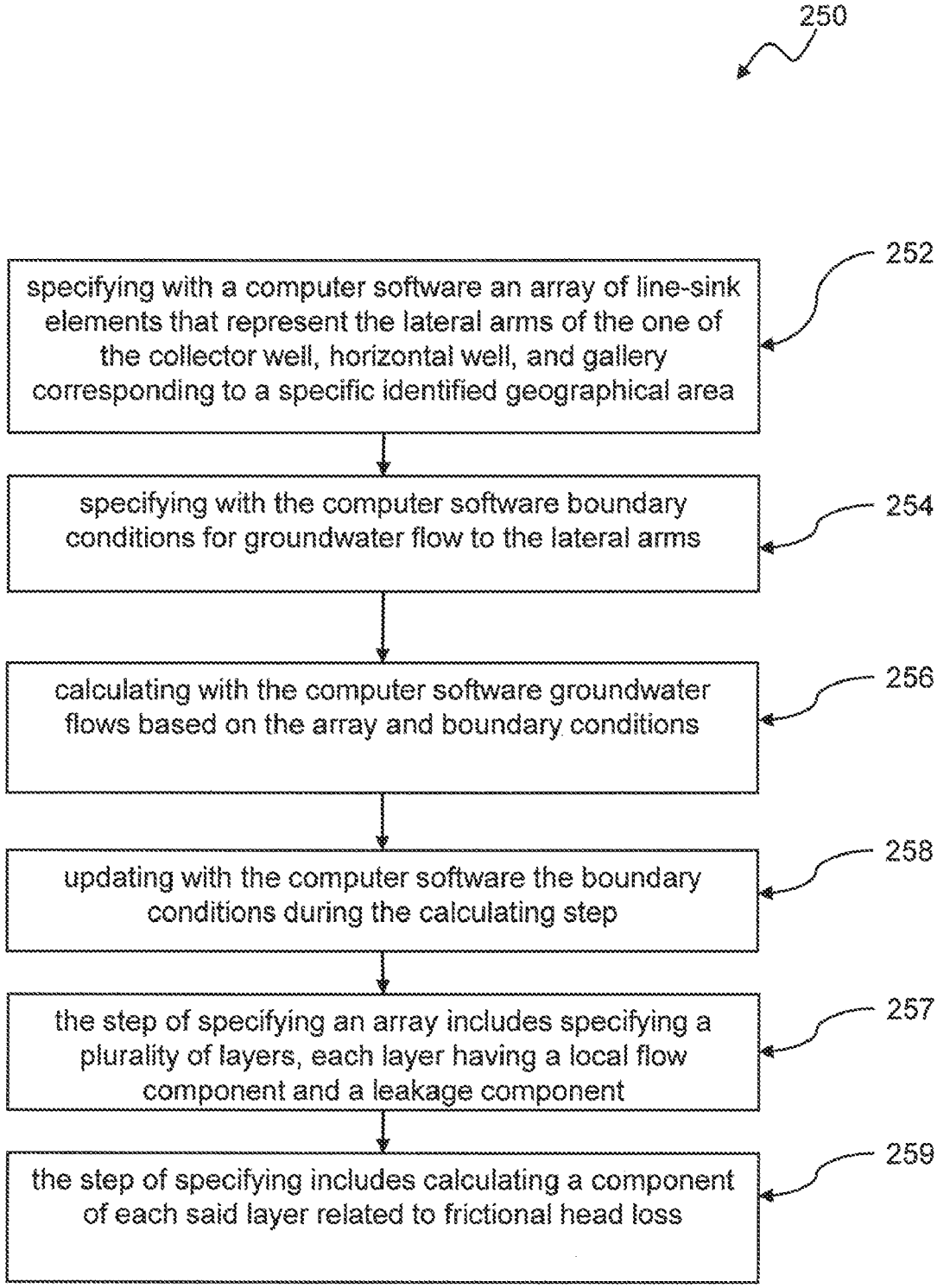
FIG. 13 illustrates a refinement of the method of FIG. 12.

Referring to FIG. 13, an exemplary computer implemented method 250 of simulating groundwater flow to one of a collector well, horizontal well, and gallery on a processor is illustrated. The method 250 including the step of specifying with a computer software an array of line-sink elements that represent the lateral arms of the one of the collector well, horizontal well, and gallery corresponding to a specific identified geographical area (as represented by block 252). The method 250 including the step of specifying with the computer software boundary conditions for groundwater flow to the lateral arms (as represented by block 254). The method 250 including the step of calculating with the computer software groundwater flows based on the array and boundary conditions (as represented by block 256). The method 250 including the step of updating with the computer software the boundary conditions during the calculating step (as represented by block 258). The step of specifying an array includes specifying a plurality of layers, each layer having a local flow component and a leakage component (as represented by block 257). The step of specifying includes calculating a component of each said layer related to frictional head loss (as represented by block 259).

Figure 14:
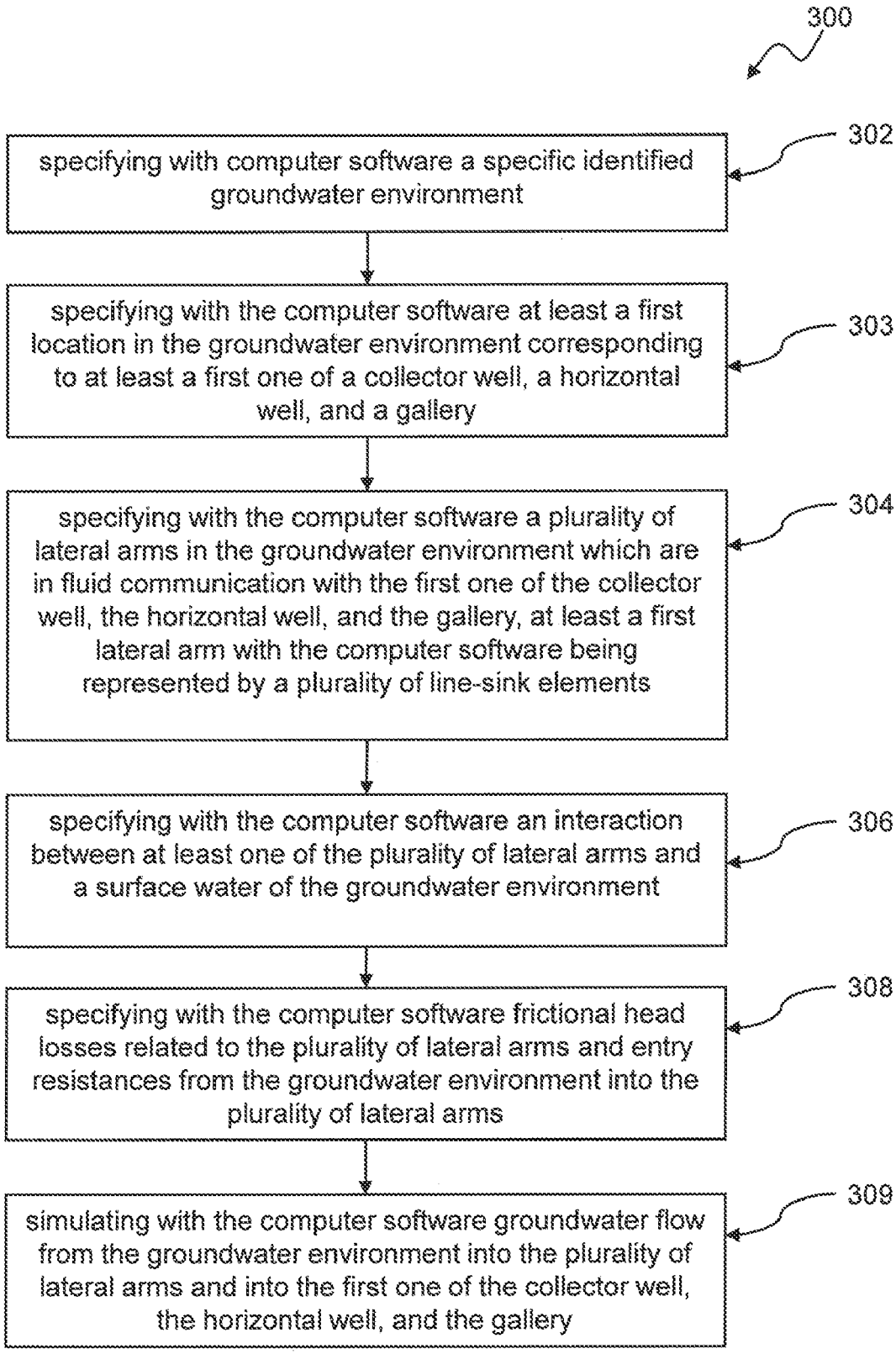
FIG. 14 illustrates a method of simulating groundwater flow.

Referring to FIG. 14, an exemplary computer implemented method 300 of simulating groundwater flow on a processor is illustrated. The method 300 including the step of specifying with a computer software a specific identified groundwater environment (as represented by block 302). The method 300 including the step of specifying with the computer software at least a first location in the groundwater environment corresponding to at least a first one of a collector well, a horizontal well, and a gallery (as represented by block 303). The method 300 including the step of specifying with the computer software a plurality of lateral arms in the groundwater environment which are in fluid communication with the first one of the collector well, the horizontal well, and the gallery, at least a first lateral arm being represented with the computer software by a plurality of line-sink elements (as represented by block 304). The method 300 including the step of specifying with the computer software an interaction between at least one of the plurality of lateral arms and a surface water of the groundwater environment (as represented by block 306). The method 300 including the step of specifying with the computer software frictional head losses related to the plurality of lateral arms and entry resistances from the groundwater environment into the plurality of lateral arms (as represented by block 308). The method 300 including the step of simulating with the computer software groundwater flow from the groundwater environment into the plurality of lateral arms and into the first one of the collector well, the horizontal well, and the gallery (as represented by block 309).

Figure 15:
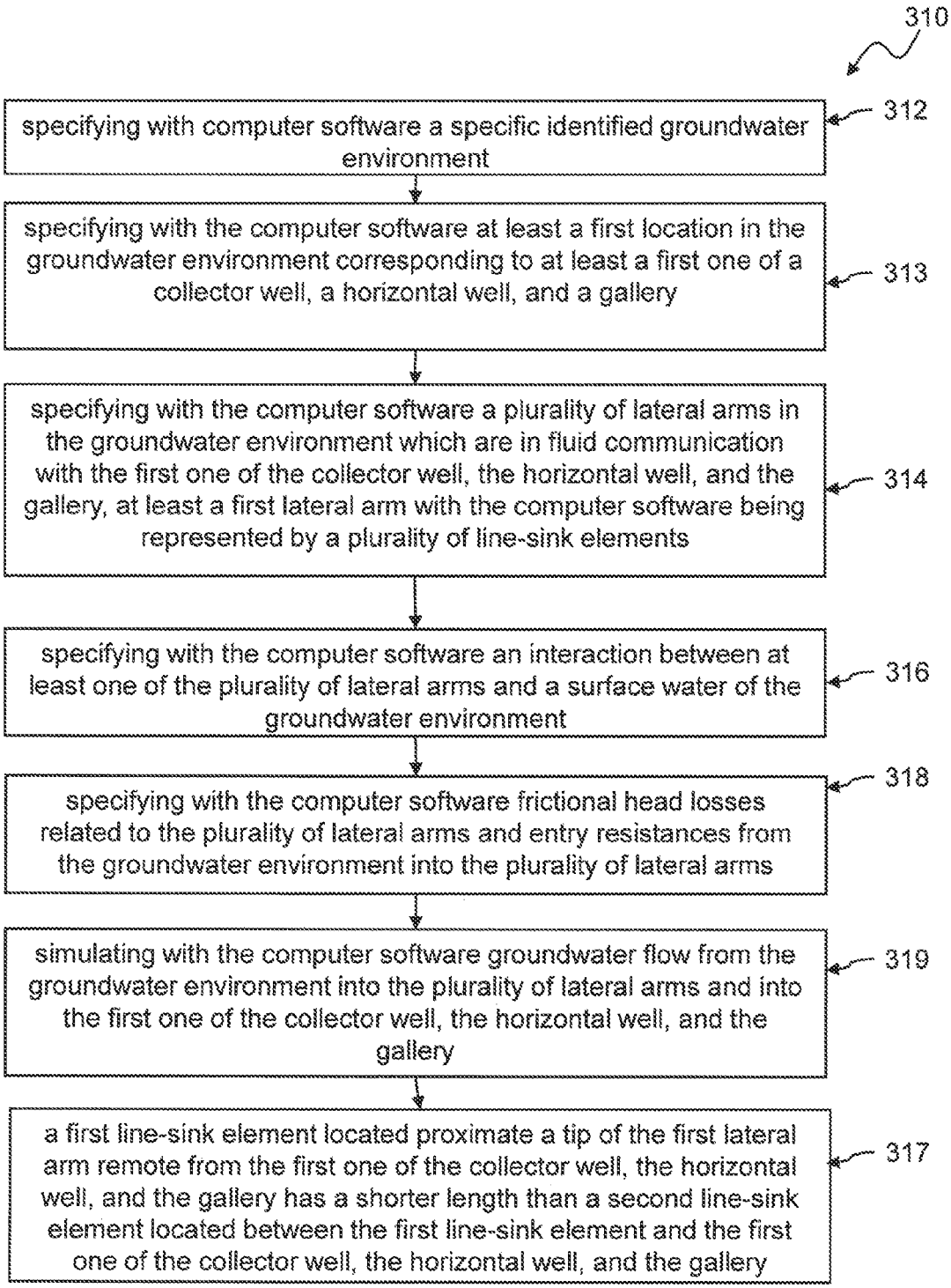
FIG. 15 illustrates a variation of the method of FIG. 14.

Referring to FIG. 15, an exemplary computer implemented method 310 of simulating groundwater flow on a processor is illustrated. The method 310 including the step of specifying with a computer software a specific identified groundwater environment (as represented by block 312). The method 310 including the step of specifying with the computer software at least a first location in the groundwater environment corresponding to at least a first one of a collector well, a horizontal well, and a gallery (as represented by block 313). The method 310 including the step of specifying with the computer software a plurality of lateral arms in the groundwater environment which are in fluid communication with the first one of the collector well, the horizontal well, and the gallery, at least a first lateral arm being represented with the computer software by a plurality of line-sink elements (as represented by block 314). The method 310 including the step of specifying with the computer software an interaction between at least one of the plurality of lateral arms and a surface water of the groundwater environment (as represented by block 316). The method 310 including the step of specifying with the computer software frictional head losses related to the plurality of lateral arms and entry resistances from the groundwater environment into the plurality of lateral arms (as represented by block 318). The method 310 including the step of simulating with the computer software groundwater flow from the groundwater environment into the plurality of lateral arms and into the first one of the collector well, the horizontal well, and the gallery (as represented by block 319). A first line-sink element located proximate a tip of the first lateral arm remote from the first one of the collector well, the horizontal well, and the gallery has a shorter length than a second line-sink element located between the first line-sink element and the first one of the collector well, the horizontal well, and the gallery (as represented by block 317).

Figure 16:
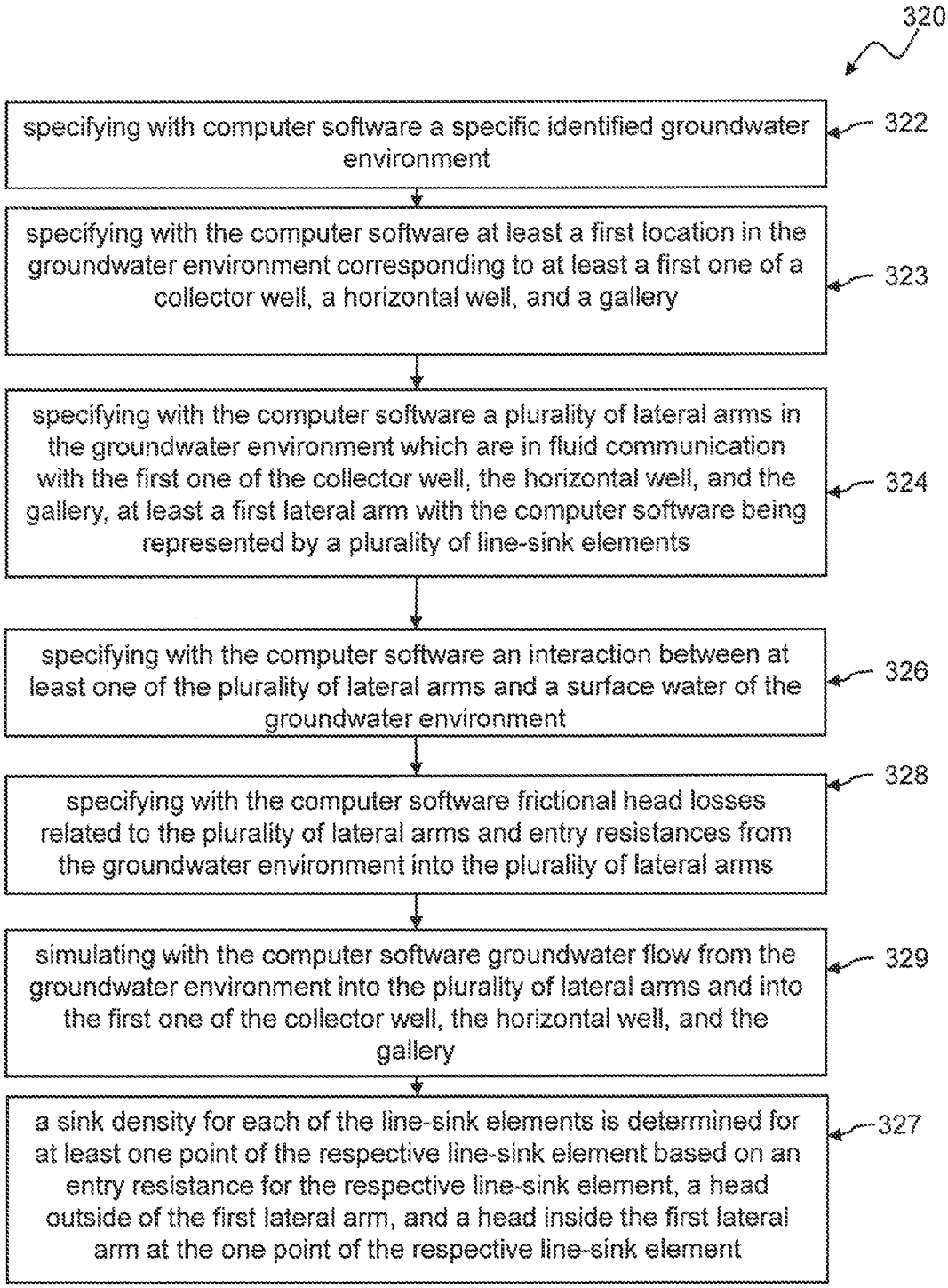
FIG. 16 illustrates a variation of the method of FIG. 14.

Referring to FIG. 16, an exemplary computer implemented method 320 of simulating groundwater flow on a processor is illustrated. The method 320 including the step of specifying with a computer software a specific identified groundwater environment (as represented by block 322). The method 320 including the step of specifying with the computer software at least a first location in the groundwater environment corresponding to at least a first one of a collector well, a horizontal well, and a gallery (as represented by block 323). The method 320 including the step of specifying with the computer software a plurality of lateral arms in the groundwater environment which are in fluid communication with the first one of the collector well, the horizontal well, and the gallery, at least a first lateral arm being represented with the computer software by a plurality of line-sink elements (as represented by block 324). The method 320 including the step of specifying with the computer software an interaction between at least one of the plurality of lateral arms and a surface water of the groundwater environment (as represented by block 326). The method 320 including the step of specifying with the computer software frictional head losses related to the plurality of lateral arms and entry resistances from the groundwater environment into the plurality of lateral arms (as represented by block 328). The method 320 including the step of simulating with the computer software groundwater flow from the groundwater environment into the plurality of lateral arms and into the first one of the collector well, the horizontal well, and the gallery (as represented by block 329). A sink density for each of the line-sink elements is determined for at least one point of the respective line-sink element based on an entry resistance for the respective line-sink element, a head outside of the first lateral arm, and a head inside the first lateral arm at the one point of the respective line-sink element (as represented by block 327).

Figure 17:
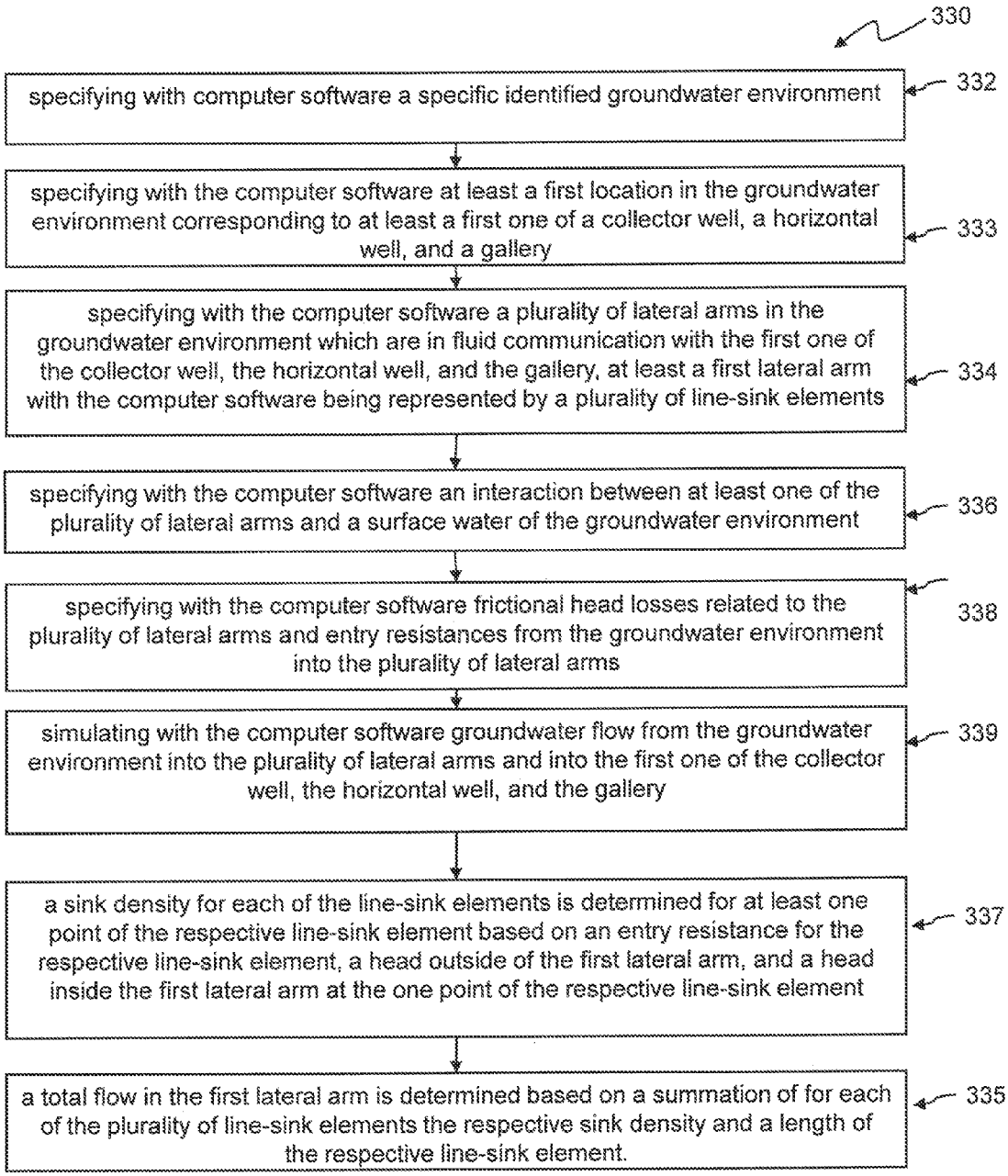
FIG. 17 illustrates a refinement of the method of FIG. 16.

Referring to FIG. 17, an exemplary computer implemented method 330 of simulating groundwater flow on a processor is illustrated. The method 330 including the step of specifying with a computer software a specific identified groundwater environment (as represented by block 332). The method 330 including the step of specifying with the computer software at least a first location in the groundwater environment corresponding to at least a first one of a collector well, a horizontal well, and a gallery (as represented by block 333). The method 330 including the step of specifying with the computer software a plurality of lateral arms in the groundwater environment which are in fluid communication with the first one of the collector well, the horizontal well, and the gallery, at least a first lateral arm being represented with the computer software by a plurality of line-sink elements (as represented by block 334). The method 330 including the step of specifying with the computer software an interaction between at least one of the plurality of lateral arms and a surface water of the groundwater environment (as represented by block 336). The method 330 including the step of specifying with the computer software frictional head losses related to the plurality of lateral arms and entry resistances from the groundwater environment into the plurality of lateral arms (as represented by block 338). The method 330 including the step of simulating with the computer software groundwater flow from the groundwater environment into the plurality of lateral arms and into the first one of the collector well, the horizontal well, and the gallery (as represented by block 339). A sink density for each of the line-sink elements is determined for at least one point of the respective line-sink element based on an entry resistance for the respective line-sink element, a head outside of the first lateral arm, and a head inside the first lateral arm at the one point of the respective line-sink element (as represented by block 337). A total flow in the first lateral arm is determined based on a summation of for each of the plurality of line-sink elements the respective sink density and a length of the respective line-sink element (as represented by block 335).

Figure 18:
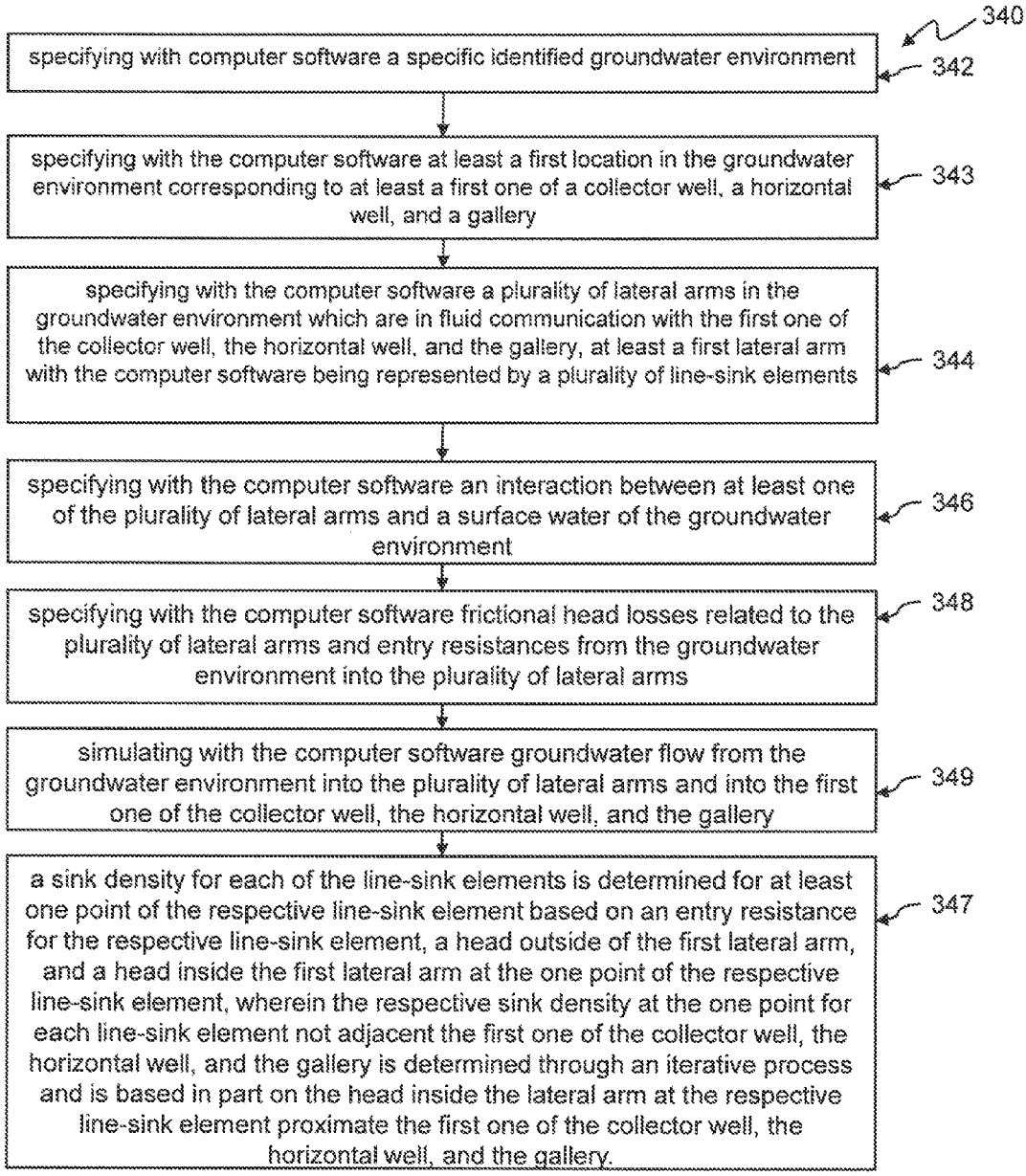
FIG. 18 illustrates a refinement of the method of FIG. 16.

Referring to FIG. 18, an exemplary computer implemented method 340 of simulating groundwater flow on a processor is illustrated. The method 340 including the step of specifying with a computer software a specific identified groundwater environment (as represented by block 342). The method 340 including the step of specifying with the computer software at least a first location in the groundwater environment corresponding to at least a first one of a collector well, a horizontal well, and a gallery (as represented by block 343). The method 340 including the step of specifying with the computer software a plurality of lateral arms in the groundwater environment which are in fluid communication with the first one of the collector well, the horizontal well, and the gallery, at least a first lateral arm being represented with the computer software by a plurality of line-sink elements (as represented by block 344). The method 340 including the step of specifying with the computer software an interaction between at least one of the plurality of lateral arms and a surface water of the groundwater environment (as represented by block 346). The method 340 including the step of specifying with the computer software frictional head losses related to the plurality of lateral arms and entry resistances from the groundwater environment into the plurality of lateral arms (as represented by block 348). The method 340 including the step of simulating with the computer software groundwater flow from the groundwater environment into the plurality of lateral arms and into the first one of the collector well, the horizontal well, and the gallery (as represented by block 349). A sink density for each of the line-sink elements is determined for at least one point of the respective line-sink element based on an entry resistance for the respective line-sink element, a head outside of the first lateral arm, and a head inside the first lateral arm at the one point of the respective line-sink element. The respective sink density at the one point for each line-sink element not adjacent the first one of the collector well, the horizontal well, and the gallery is determined through an iterative process and is based in part on the head inside the lateral arm at the respective line-sink element proximate the first one of the collector well, the horizontal well, and the gallery (as represented by block 347).

Figure 19:
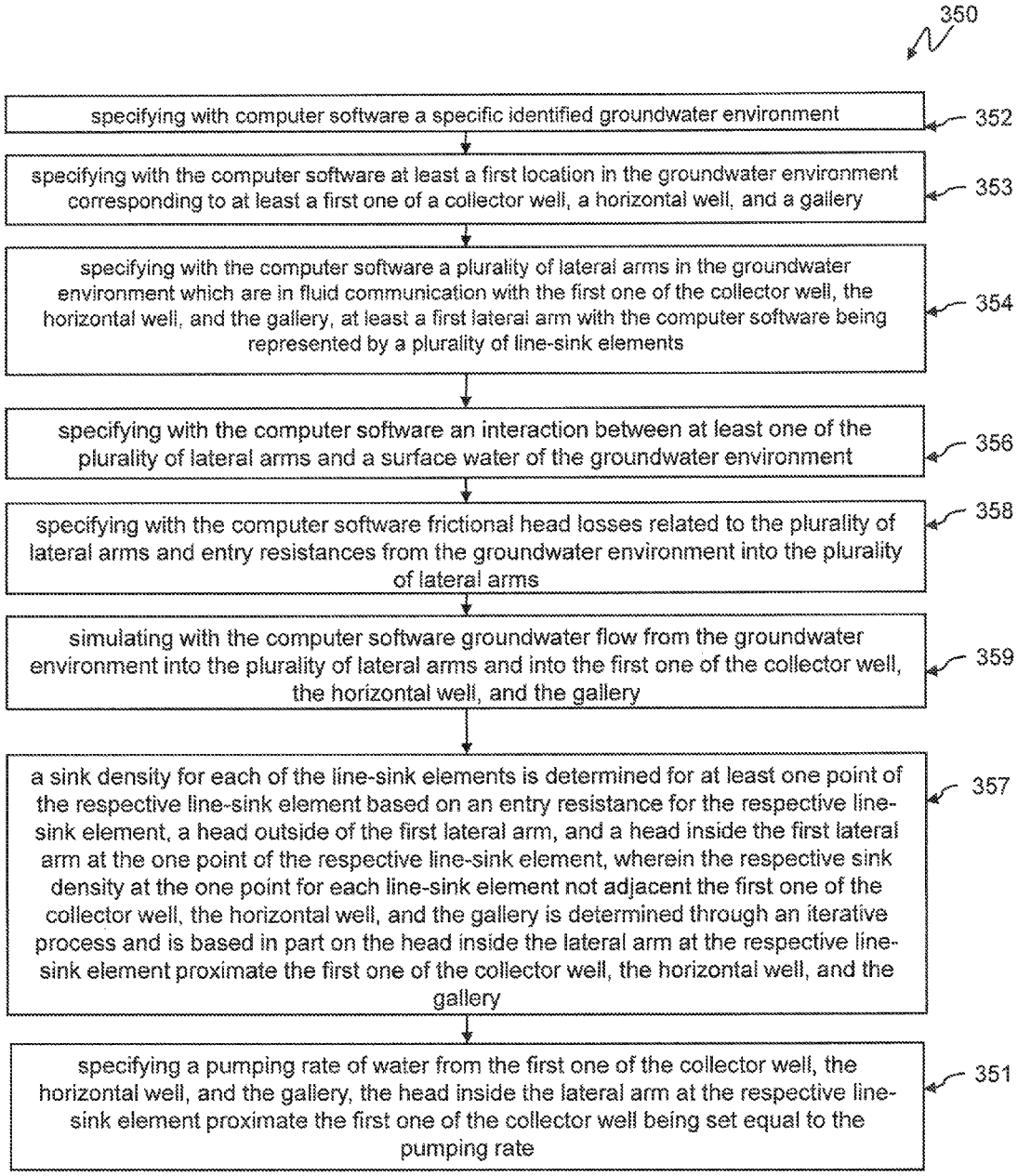
FIG. 19 illustrates a refinement of the method of FIG. 18.

Referring to FIG. 19, an exemplary computer implemented method 350 of simulating groundwater flow on a processor is illustrated. The method 350 including the step of specifying with a computer software a specific identified groundwater environment (as represented by block 352). The method 350 including the step of specifying with the computer software at least a first location in the groundwater environment corresponding to at least a first one of a collector well, a horizontal well, and a gallery (as represented by block 353). The method 350 including the step of specifying with the computer software a plurality of lateral arms in the groundwater environment which are in fluid communication with the first one of the collector well, the horizontal well, and the gallery, at least a first lateral arm being represented with the computer software by a plurality of line-sink elements (as represented by block 354). The method 350 including the step of specifying with the computer software an interaction between at least one of the plurality of lateral arms and a surface water of the groundwater environment (as represented by block 356). The method 350 including the step of specifying with the computer software frictional head losses related to the plurality of lateral arms and entry resistances from the groundwater environment into the plurality of lateral arms (as represented by block 358). The method 350 including the step of simulating with the computer software groundwater flow from the groundwater environment into the plurality of lateral arms and into the first one of the collector well, the horizontal well, and the gallery (as represented by block 359). A sink density for each of the line-sink elements is determined for at least one point of the respective line-sink element based on an entry resistance for the respective line-sink element, a head outside of the first lateral arm, and a head inside the first lateral arm at the one point of the respective line-sink element. The respective sink density at the one point for each line-sink element not adjacent the first one of the collector well, the horizontal well, and the gallery is determined through an iterative process and is based in part on the head inside the lateral arm at the respective line-sink element proximate the first one of the collector well, the horizontal well, and the gallery (as represented by block 357). The method 350 including the step of specifying a pumping rate of water from the first one of the collector well, the horizontal well, and the gallery, the head inside the lateral arm at the respective line-sink element proximate the first one of the collector well being set equal to the pumping rate (as represented by block 351).

Figure 20:
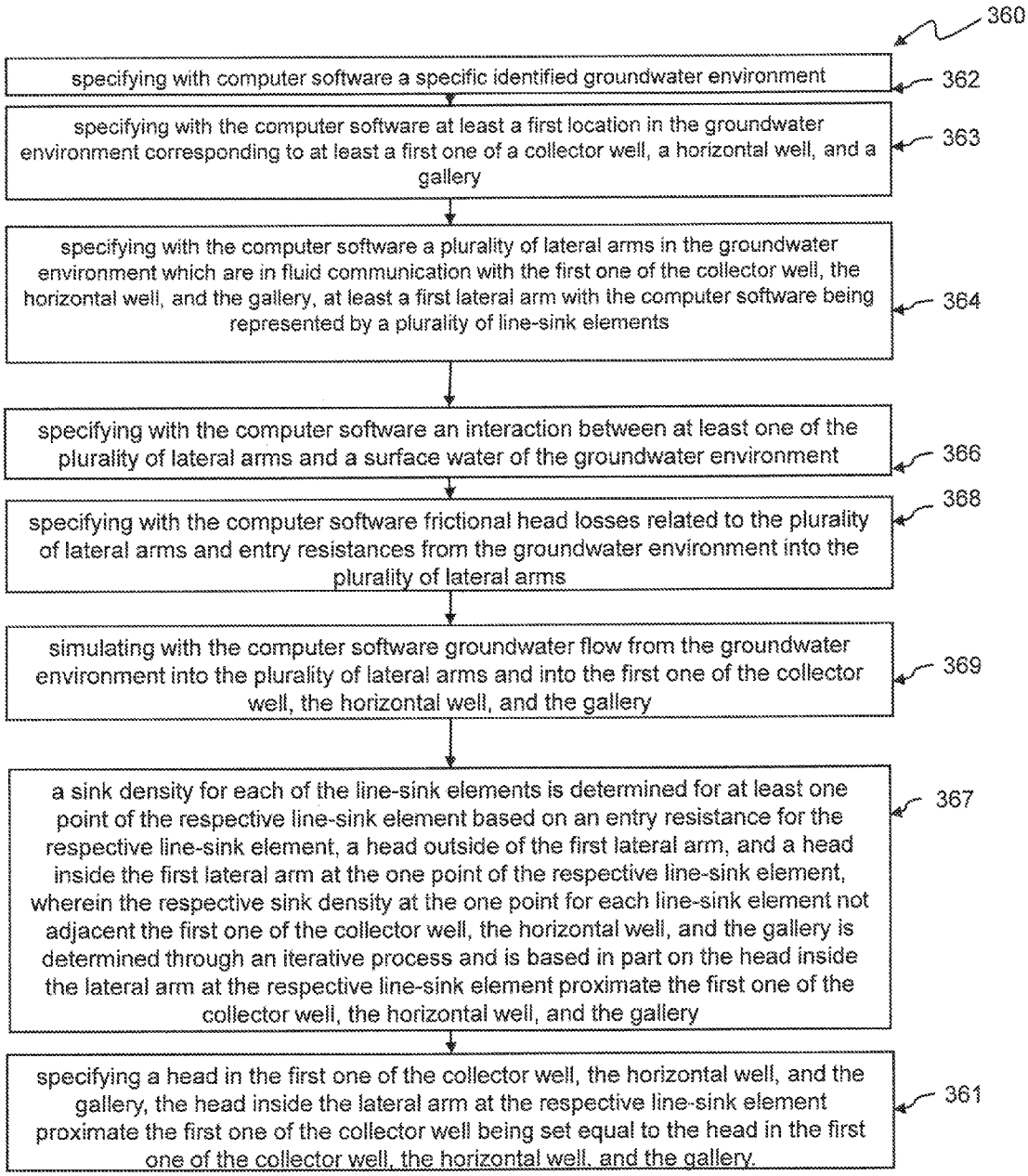
FIG. 20 illustrates a refinement of the method of FIG. 18.

Referring to FIG. 20, an exemplary computer implemented method 360 of simulating groundwater flow on a processor is illustrated. The method 360 including the step of specifying with a computer software a specific identified groundwater environment (as represented by block 362). The method 360 including the step of specifying with the computer software at least a first location in the groundwater environment corresponding to at least a first one of a collector well, a horizontal well, and a gallery (as represented by block 363). The method 360 including the step of specifying with the computer software a plurality of lateral arms in the groundwater environment which are in fluid communication with the first one of the collector well, the horizontal well, and the gallery, at least a first lateral arm being represented with the computer software by a plurality of line-sink elements (as represented by block 364). The method 360 including the step of specifying with the computer software an interaction between at least one of the plurality of lateral arms and a surface water of the groundwater environment (as represented by block 366). The method 360 including the step of specifying with the computer software frictional head losses related to the plurality of lateral arms and entry resistances from the groundwater environment into the plurality of lateral arms (as represented by block 368). The method 360 including the step of simulating with the computer software groundwater flow from the groundwater environment into the plurality of lateral arms and into the first one of the collector well, the horizontal well, and the gallery (as represented by block 369). A sink density for each of the line-sink elements is determined for at least one point of the respective line-sink element based on an entry resistance for the respective line-sink element, a head outside of the first lateral arm, and a head inside the first lateral arm at the one point of the respective line-sink element. The respective sink density at the one point for each line-sink element not adjacent the first one of the collector well, the horizontal well, and the gallery is determined through an iterative process and is based in part on the head inside the lateral arm at the respective line-sink element proximate the first one of the collector well, the horizontal well, and the gallery (as represented by block 367). The method 360 including the step of specifying a head in the first one of the collector well, the horizontal well, and the gallery, the head inside the lateral arm at the respective line-sink element proximate the first one of the collector well being set equal to the head in the first one of the collector well, the horizontal well, and the gallery (as represented by block 361).

Figure 21:
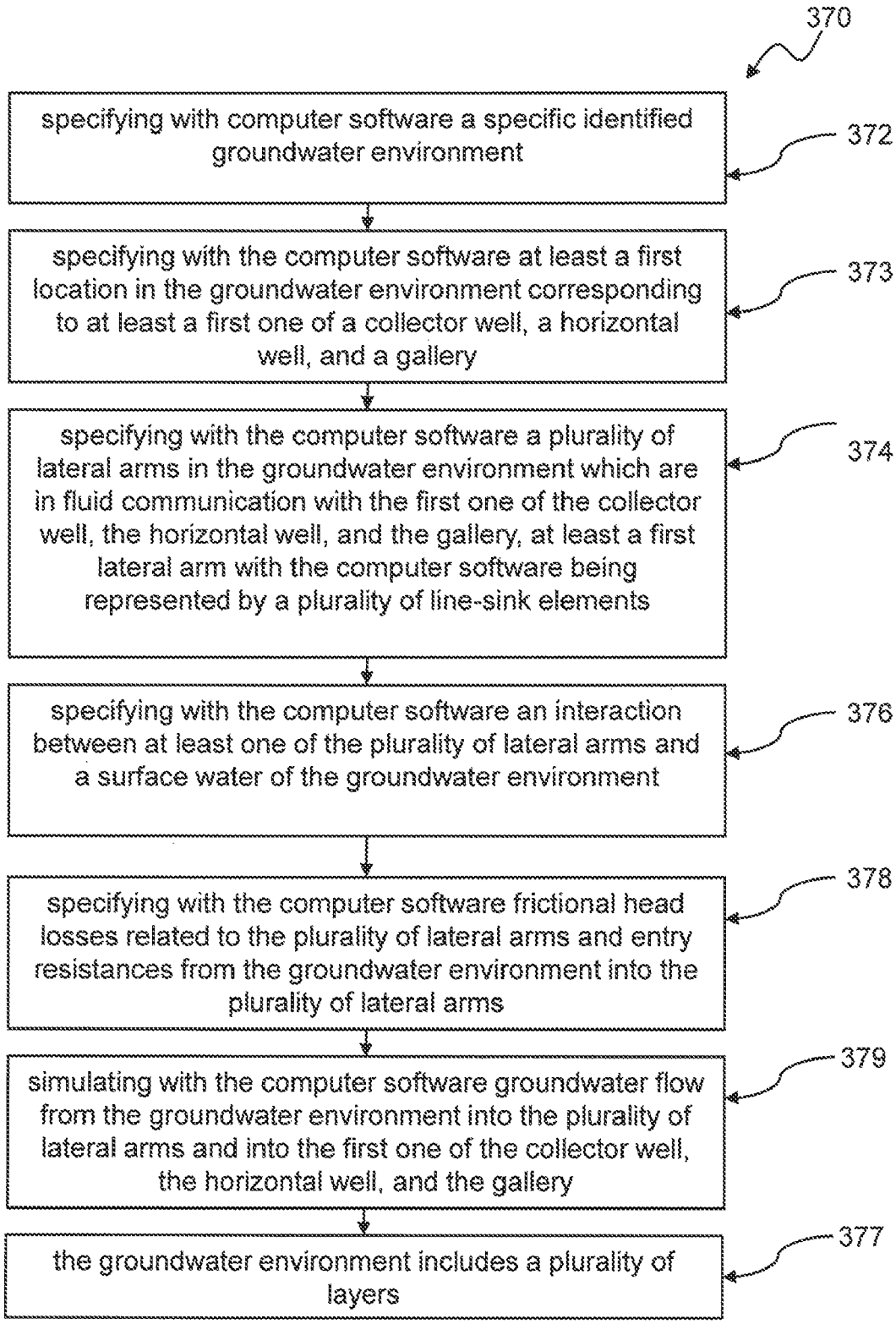
FIG. 21 illustrates a variation of the method of FIG. 8.

Referring to FIG. 21, an exemplary computer implemented method 370 of simulating groundwater flow on a processor is illustrated. The method 370 including the step of specifying with a computer software a specific identified groundwater environment (as represented by block 372). The method 370 including the step of specifying with the computer software at least a first location in the groundwater environment corresponding to at least a first one of a collector well, a horizontal well, and a gallery (as represented by block 373). The method 370 including the step of specifying with the computer software a plurality of lateral arms in the groundwater environment which are in fluid communication with the first one of the collector well, the horizontal well, and the gallery, at least a first lateral arm being represented with the computer software by a plurality of line-sink elements (as represented by block 374). The method 370 including the step of specifying with the computer software an interaction between at least one of the plurality of lateral arms and a surface water of the groundwater environment (as represented by block 376). The method 370 including the step of specifying with the computer software frictional head losses related to the plurality of lateral arms and entry resistances from the groundwater environment into the plurality of lateral arms (as represented by block 378). The method 370 including the step of simulating with the computer software groundwater flow from the groundwater environment into the plurality of lateral arms and into the first one of the collector well, the horizontal well, and the gallery (as represented by block 379). The groundwater environment includes a plurality of layers (as represented by block 377).

Figure 22:
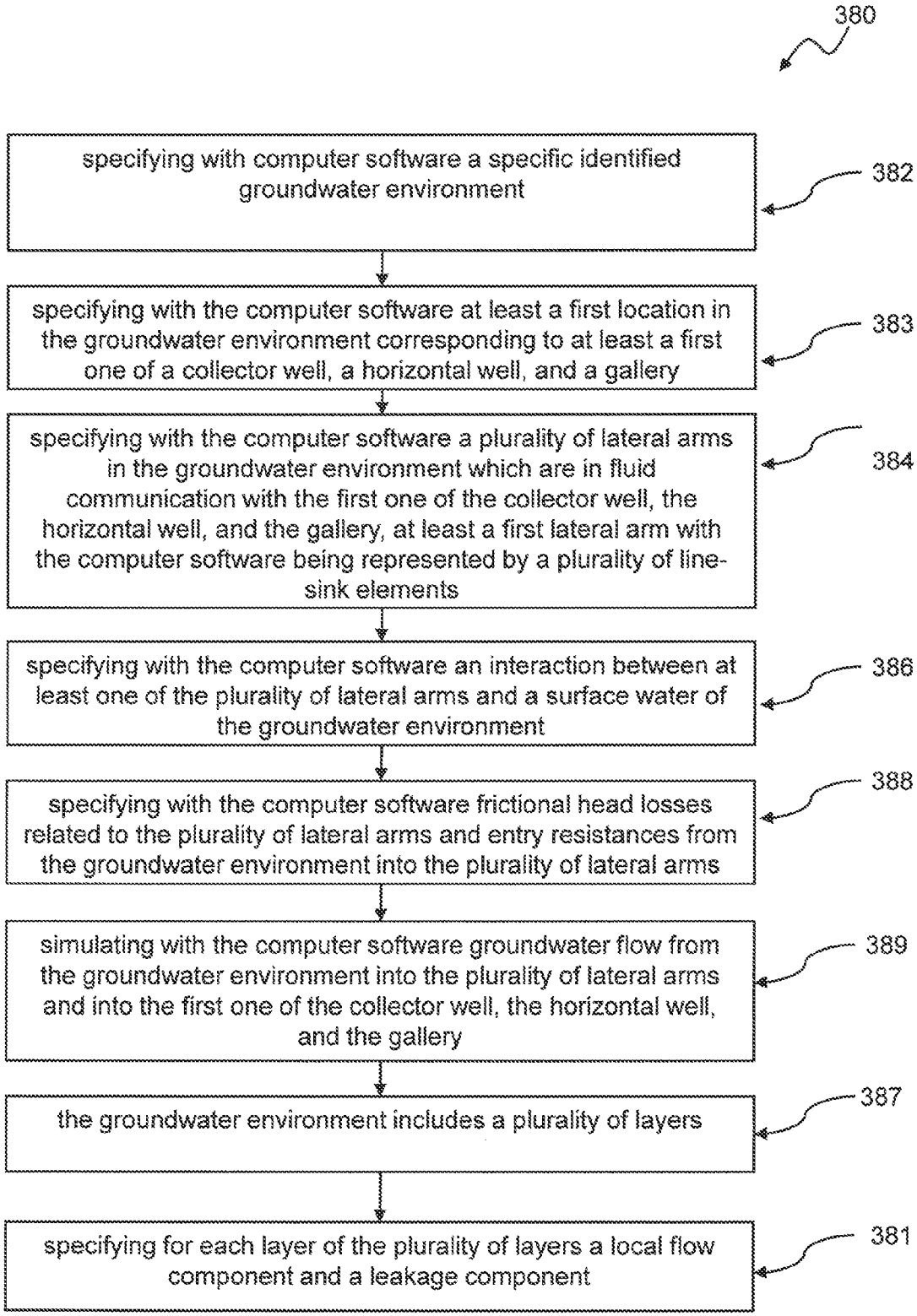
FIG. 22 illustrates a refinement of the method of FIG. 21.

Referring to FIG. 22, an exemplary computer implemented method 380 of simulating groundwater flow on a processor is illustrated. The method 380 including the step of specifying with a computer software a specific identified groundwater environment (as represented by block 382). The method 380 including the step of specifying with the computer software at least a first location in the groundwater environment corresponding to at least a first one of a collector well, a horizontal well, and a gallery (as represented by block 383). The method 380 including the step of specifying with the computer software a plurality of lateral arms in the groundwater environment which are in fluid communication with the first one of the collector well, the horizontal well, and the gallery, at least a first lateral arm being represented with the computer software by a plurality of line-sink elements (as represented by block 384). The method 380 including the step of specifying with the computer software an interaction between at least one of the plurality of lateral arms and a surface water of the groundwater environment (as represented by block 386). The method 380 including the step of specifying with the computer software frictional head losses related to the plurality of lateral arms and entry resistances from the groundwater environment into the plurality of lateral arms (as represented by block 388). The method 380 including the step of simulating with the computer software groundwater flow from the groundwater environment into the plurality of lateral arms and into the first one of the collector well, the horizontal well, and the gallery (as represented by block 389). The groundwater environment includes a plurality of layers (as represented by block 387). The method 380 including the step of specifying for each layer of the plurality of layers a local flow component and a leakage component (as represented by block 381).

Figure 23:
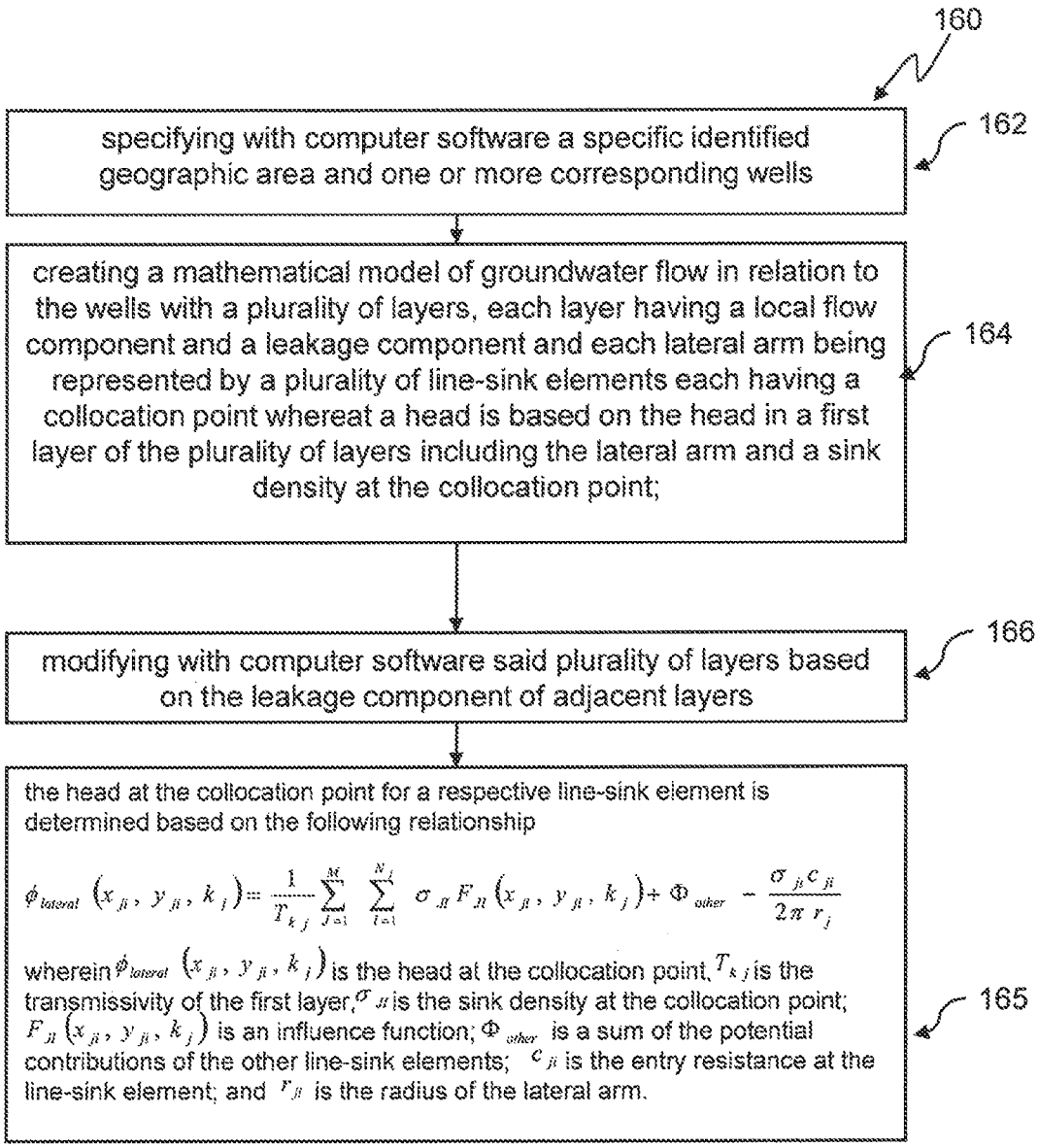
FIG. 23 illustrates a variation of the method of FIG. 2.

Referring to FIG. 23, an exemplary computer implemented method 160 of developing a model of groundwater flow with a well configuration on a processor is illustrated. The method 160 including the step of specifying with computer software a specific identified geographic area and one or more corresponding wells, each well having a plurality of lateral arms connected to the well (as represented by block 162). The method 160 including the step of creating a mathematical model of groundwater flow in relation to the wells with a plurality of layers with computer software (as represented by block 164). Each layer having a local flow component and a leakage component. Each lateral arm being represented by a plurality of line-sink elements each having a collocation point whereat a head is based on the head in a first layer of the plurality of layers including the lateral arm and a sink density at the collocation point. The method 160 including the step of modifying with computer software said plurality of layers based on the leakage component of adjacent layers (as represented by block 166). The head at the collocation point for a respective line-sink element is determined based on the following relationship $$\phi_{lateral}(x_{ji}, y_{ji}, k_j)=1/T_{kj}\Sigma_{J=1}^{M}\Sigma_{I=1}^{Nj}\sigma_{JI}F_{JI}(x_{ji}, y_{ji}, k_j)+\Phi_{other}-\sigma_{ji}c_{ji}/2\pi r_j$$

wherein $\phi_{lateral(xji}, y_{ji}, k_j)$ is the head at the collocation point, $T_{kj}$ is the transmissivity of the first layer, $\sigma_{JI}$ is the sink density at the collocation point; $F_{JI}(x_{ji}, y_{ji}, k_j)$ is an influence function; $\Phi_{other}$ is a sum of the potential contributions of the other line-sink elements; $c_{ji}$ is the entry resistance at the line-sink element; and $r_{ji}$ is the radius of the lateral arm (as represented by block 165).

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

We claim:

1. A computer implemented method of developing a model of groundwater flow with a well configuration comprising the steps of, on a processor:

specifying with computer software a specific identified geographic area and one or more corresponding wells, each well having a plurality of lateral arms connected to the well;

creating a mathematical model of groundwater flow in relation to the wells with a plurality of layers with computer software, each layer having a local flow component and a leakage component and each lateral arm being represented by a plurality of line-sink elements each having a collocation point whereat a head is based on the head in a first layer of the plurality of layers including the lateral arm and a sink density at the collocation point; and modifying with computer software said plurality of layers based on the leakage component of adjacent layers.

2. The method of claim 1 wherein the step of creating includes creating for each of the layers a component related to frictional head loss.

3. The method of claim 2 wherein the step of specifying includes calculating a component of each said layer related to frictional head loss.

4. The method of claim 1 wherein the step of specifying layers includes using the head losses due to flow into and within the lateral arms.

5. The method of claim 1 wherein the step of modifying involves calculating discharge potentials.

6. The method of claim 1 wherein the step of modifying includes specifying one of a discharge-condition and a head specified condition.

7. A computer implemented method of simulating groundwater flow to one of a collector well, horizontal well, and gallery comprising the steps of, on a processor:

specifying with computer software an array of line-sink elements that represent the lateral arms of the one of the collector well, horizontal well, and gallery corresponding to a specific identified geographical area;

specifying with the computer software boundary conditions for groundwater flow to the lateral arms;

calculating with the computer software groundwater flows based on the array and boundary conditions; and updating with the computer software the boundary conditions during the calculating step.

8. The method of claim 7 wherein the step of calculating involves calculating discharge potentials.

9. The method of claim 7 wherein the step of specifying boundary conditions includes specifying one of a discharge-condition and a head specified condition.

10. The method of claim 7 wherein the step of specifying an array includes specifying a plurality of layers, each layer having a local flow component and a leakage component.

11. The method of claim 10 wherein in the step of specifying includes calculating a component of each said layer related to frictional head loss.

12. A computer implemented method of simulating groundwater flow, comprising the steps of, on a processor:

specifying with computer software a specific identified groundwater environment;

specifying with the computer software at least a first location in the groundwater environment corresponding to at least a first one of a collector well, a horizontal well, and a gallery;

specifying with the computer software a plurality of lateral arms in the groundwater environment which are in fluid communication with the first one of the collector well, the horizontal well, and the gallery, at least a first lateral arm being represented with the computer software by a plurality of line-sink elements;

specifying with the computer software an interaction between at least one of the plurality of lateral arms and a surface water of the groundwater environment;

specifying with the computer software frictional head losses related to the plurality of lateral arms and entry resistances from the groundwater environment into the plurality of lateral arms; and simulating with the computer software groundwater flow from the groundwater environment into the plurality of lateral arms and into the first one of the collector well, the horizontal well, and the gallery.

13. The method of claim 12, wherein a first line-sink element located proximate a tip of the first lateral arm remote from the first one of the collector well, the horizontal well, and the gallery has a shorter length than a second line-sink element located between the first line-sink element and the first one of the collector well, the horizontal well, and the gallery.

14. The method of claim 12, wherein a sink density for each of the line-sink elements is determined for at least one point of the respective line-sink element based on an entry resistance for the respective line-sink element, a head outside of the first lateral arm, and a head inside the first lateral arm at the one point of the respective line-sink element.

15. The method of claim 14, wherein a total flow in the first lateral arm is determined based on a summation of for each of the plurality of line-sink elements the respective sink density and a length of the respective line-sink element.

16. The method of claim 14, wherein the respective sink density at the one point for each line-sink element not adjacent the first one of the collector well, the horizontal well, and the gallery is determined through an iterative process and is based in part on the head inside the lateral arm at the respective line-sink element proximate the first one of the collector well, the horizontal well, and the gallery.

17. The method of claim 16, further comprising the step of specifying a pumping rate of water from the first one of the collector well, the horizontal well, and the gallery, the head inside the lateral arm at the respective line-sink element proximate the first one of the collector well being set equal to the pumping rate.

18. The method of claim 16, further comprising the step of specifying a head in the first one of the collector well, the horizontal well, and the gallery, the head inside the lateral arm at the respective line-sink element proximate the first one of the collector well being set equal to the head in the first one of the collector well, the horizontal well, and the gallery.

19. The method of claim 12, wherein the groundwater environment includes a plurality of layers.

20. The method of claim 19, further comprising the step of specifying for each layer of the plurality of layers a local flow component and a leakage component.

21. The method of claim 1, wherein the head at the collocation point for a respective line-sink element is determined based on the following relationship $$\phi_{lateral}(x_{ji}, y_{ji}, k_j) = \frac{1}{T_{kj}} \sum_{J=1}^{M} \sum_{I=1}^{N_j} \sigma_{JI} F_{JI}(x_{ji}, y_{ji}, k_j) + \Phi_{other} - \frac{\sigma_{ji} c_{ji}}{2\pi r_j}$$

wherein $\phi_{lateral}(x_{ji}, y_{ji}, k_j)$ is the head at the collocation point, $T_{k,j}$ is the transmissivity of the first layer, $\sigma_{JI}$ is the sink density at the collocation point; $F_{JI}(x_{ji}, y_{ji}, k_j)$ is an influence function; $\Phi_{other}$ is a sum of the potential contributions of the other line-sink elements; $c_{ji}$ is the entry resistance at the line-sink element; and is $r_{ji}$ the radius of the lateral arm.

22. The method of claim 7 wherein the step of specifying boundary conditions includes using the head losses due to flow into and within the lateral arms.

* * * * *